US006530214B2

(12) United States Patent
Ikemoto et al.

(10) Patent No.: US 6,530,214 B2
(45) Date of Patent: Mar. 11, 2003

(54) AIR-FUEL RATIO CONTROL APPARATUS HAVING SUB-FEEDBACK CONTROL

(75) Inventors: Noriaki Ikemoto, Kariya (JP); Hisashi Iida, Kariya (JP); Kouichi Shimizu, Handa (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/998,641

(22) Filed: Dec. 3, 2001

(65) Prior Publication Data

US 2002/0104310 A1 Aug. 8, 2002

(30) Foreign Application Priority Data

Feb. 5, 2001 (JP) ..... 2001-027810
Feb. 5, 2001 (JP) ..... 2001-027811
Feb. 5, 2001 (JP) ..... 2001-027812

(51) Int. Cl.[7] ..... F01N 3/00
(52) U.S. Cl. ..... 60/285; 60/276
(58) Field of Search ..... 60/276, 285; 701/103

(56) References Cited

U.S. PATENT DOCUMENTS 5,157,920 A * 10/1992 Nakaniwa ..... 60/274
5,390,489 A * 2/1995 Kawai et al. ..... 60/276
5,487,270 A * 1/1996 Yamashita et al. ..... 60/276
5,491,975 A * 2/1996 Yamashita et al. ..... 60/276
5,694,910 A * 12/1997 Hasegawa ..... 123/674
5,875,628 A * 3/1999 Mitsutani ..... 60/276
6,256,983 B1 * 7/2001 Yasui ..... 60/285
6,438,946 B1 * 8/2002 Majima et al. ..... 60/285
6,470,674 B1 * 10/2002 Yamaguchi et al. ..... 60/277
6,477,458 B1 * 11/2002 Yasui et al. ..... 701/109

FOREIGN PATENT DOCUMENTS

JP 2518247 5/1996

* cited by examiner

*Primary Examiner*—Diem Tran
(74) *Attorney, Agent, or Firm*—Nixon & Vanderhye P.C.

(57) ABSTRACT

Exhaust gas sensors are provided at the upstream side and the downstream side of a catalyst, respectively. An intermediate target value is set on the basis of the output of the downstream-side exhaust gas sensor of preceding computation time and a final target value that is a final downstream-side target air-fuel ratio. The compensation amount of the upstream-side target air-fuel ratio is calculated on the basis of the deviation between the present output of the downstream-side exhaust gas sensor and the intermediate target value. At least one of an update amount and an update rate of the intermediate value, a control gain, a control period and a control range of a sub-feedback control is varied.

15 Claims, 16 Drawing Sheets

AIR-FUEL RATIO CONTROL APPARATUS HAVING SUB-FEEDBACK CONTROL

CROSS REFERENCE TO RELATED APPLICATION

This application is based on and incorporates herein by reference Japanese Patent Applications NO. 2001-27810, NO. 2001-27811 and NO. 2001-27812, all filed on Feb. 5, 2001.

BACKGROUND OF THE INVENTION

The present invention relates to an air-fuel ratio control apparatus for an internal combustion engine for feedback-controlling the air-fuel ratio of the internal combustion engine by air-fuel ratio sensors (linear A/F sensor) or oxygen sensors which are disposed on the upstream side and the downstream-side of a catalyst for cleaning exhaust gas, respectively.

In automobiles, exhaust gas sensors (air-fuel ratio sensors or oxygen sensors) are disposed at the upstream and downstream sides of a catalyst to feedback-control a fuel injection amount so that the air-fuel ratio detected by the upstream-side exhaust gas sensor becomes an upstream-side target air-fuel ratio. A sub-feedback control is performed, by which the upstream-side target air-fuel ratio is corrected so that the air-fuel ratio detected by the downstream-side exhaust gas sensor becomes equal to a downstream-side target air-fuel ratio.

In such a main/sub-feedback system, it is proposed in Japanese Patent NO. 2518247 that as the deviation between the air-fuel ratio detected by the downstream-side exhaust gas sensor and the downstream-side target air-fuel ratio becomes larger, the update amount of an air-fuel ratio feedback control constant is increased.

The dynamic characteristics of the catalyst varies depending on the degree of deterioration of the catalyst, the state of adsorption of the lean/rich components in the catalyst, and the state of operation of an engine. In this main/sub-feedback control system, the response of the sub-feedback control to a change in the dynamic characteristics of the catalyst is not sufficient. Thus, a delay in the response of the sub-feedback control to the change in dynamic characteristics of the catalyst occurs. Thus, the air-fuel ratio on the downstream-side of the catalyst (output of the downstream-side exhaust gas sensor) becomes unstable and tends to fluctuate.

Therefore, it is proposed in U.S. application Ser. No. 09/838591 filed on Apr. 20, 2001 (Japanese Patent Application NO. 2000-464671) to set an intermediate target value of the sub-feedback control on the basis of the air-fuel ratio previously detected by the downstream-side exhaust gas sensor and a final downstream-side target air-fuel ratio and to perform the sub-feedback control for correcting an upstream-side air-fuel ratio on the basis of the deviation between the air-fuel ratio detected by the downstream-side exhaust gas sensor and the intermediate target value.

In this system, a three-way catalyst used for cleaning an exhaust gas cleans the exhaust gas by oxidizing or reducing rich components (HC, CO, etc.) and lean components (NOx, oxygen, etc.) in the exhaust gas or by making the catalyst adsorb the rich components and lean components in the exhaust gas. When the exhaust gas continues to be biased to a lean or rich state, the amount of the lean components or the rich components adsorbed by the catalyst increases and finally the adsorption amount of the catalyst becomes saturated. When the catalyst becomes the state of saturated adsorption, the air-fuel ratio on the upstream-side of the catalyst is controlled by a sub-feedback control in the direction which reduces the adsorption amount of the catalyst. During a period from the state where the catalyst is in the state of saturated adsorption to the state where the catalyst is returned to the state of insufficient adsorption, however, the storage state of the catalyst is unstable. If the sub-feedback control with high response using an intermediate target value is performed under the same conditions as in a normal state, the sub-feedback control is becomes unstable and causes over-shooting or fluctuation which results in increasing uncleaned exhaust gas.

Further, the catalyst has a delay system (dead time and time constant) which largely varies depending on an exhaust gas flow and a catalyst reaction rate. In this case, if the intermediate target value used for the sub-feedback control is updated under slow conditions so as to prevent fluctuation, the intermediate target value is suitably updated in the case of a small exhaust gas flow or in the case of a slow catalyst reaction rate (in the case where the cleaning performance of the catalyst is reduced). However, in the case of a large exhaust gas flow or in the case of a fast catalyst reaction rate, the update of the intermediate target value (response of the sub-feedback control) is too late to ensure a sufficient performance in cleaning the exhaust gas.

Still further, as the downstream-side exhaust gas sensor, an oxygen sensor ($O_2$ sensor) is used. This sensor output characteristic is inverted depending on whether the air-fuel ratio of the exhaust gas is rich or lean. The output characteristic of the oxygen sensor is referred to as a Z-characteristic. Specifically, in a region where an air-fuel ratio is near the stoichiometric air-fuel ratio region (excess air ratio $\lambda=1$), that is, in a region where the output voltage of the oxygen sensor is from 0.3 V to 0.7 V, even if a change in an air-fuel ratio is small, the output voltage of the oxygen sensor changes largely. On the other hand, where the output voltage is in a rich region of 0.7 V or more or in a lean region of 0.3 V or less, a change in the output voltage of the oxygen sensor with respect to a change in the air-fuel ratio becomes small.

If the sub-feedback control is performed by setting the intermediate target value (intermediate target voltage) by using the output voltage of the oxygen sensor having the Z-type characteristic like this as it is, because a change in the output voltage of the oxygen sensor with respect to a change of the air-fuel ratio is small in a rich region of 0.7 V or more and a lean region of 0.3 V or less, the update amount of the intermediate target value (intermediate target voltage) is made small with respect to a change in an actual air-fuel ratio to delay the response of the sub-feedback control with respect to a change in the air-fuel ratio. Thus, the delay in the response increases the exhaust amount of HC, CO in the rich region of 0.7 V or more and the exhaust amount of NOx in the lean region of 0.3 V or less.

Still further, because a change in the output voltage of the oxygen sensor with respect to a change of the air-fuel ratio is steep in the region of the stoichiometric air-fuel ratio (from 0.3 to 0.7 V), the update amount of the intermediate target value (intermediate target voltage) is made too large with respect to a change in the air-fuel ratio. Thereby a fluctuation tends to occur in the sub-feedback control and reduce the stability of the sub-feedback control.

SUMMARY OF THE INVENTION

It is therefore an object of the present invention to provide an air-fuel ratio control apparatus which provides improved performance in exhaust gas cleaning.

According to the present invention, exhaust gas sensors are provided at the upstream side and the downstream side of a catalyst, respectively. An intermediate target value is set on the basis of the output of the downstream-side exhaust gas sensor of preceding computation time and a final target value that is a final downstream-side target air-fuel ratio. The compensation amount of the upstream-side target air-fuel ratio is calculated on the basis of the deviation between the present output of the downstream-side exhaust gas sensor and the intermediate target value. At least one of an update amount and an update rate of the intermediate value, a control gain, a control period and a control range of a sub-feedback control is varied.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

The present invention will be described in further detail with reference to various embodiments.

First Embodiment

Figure 1:
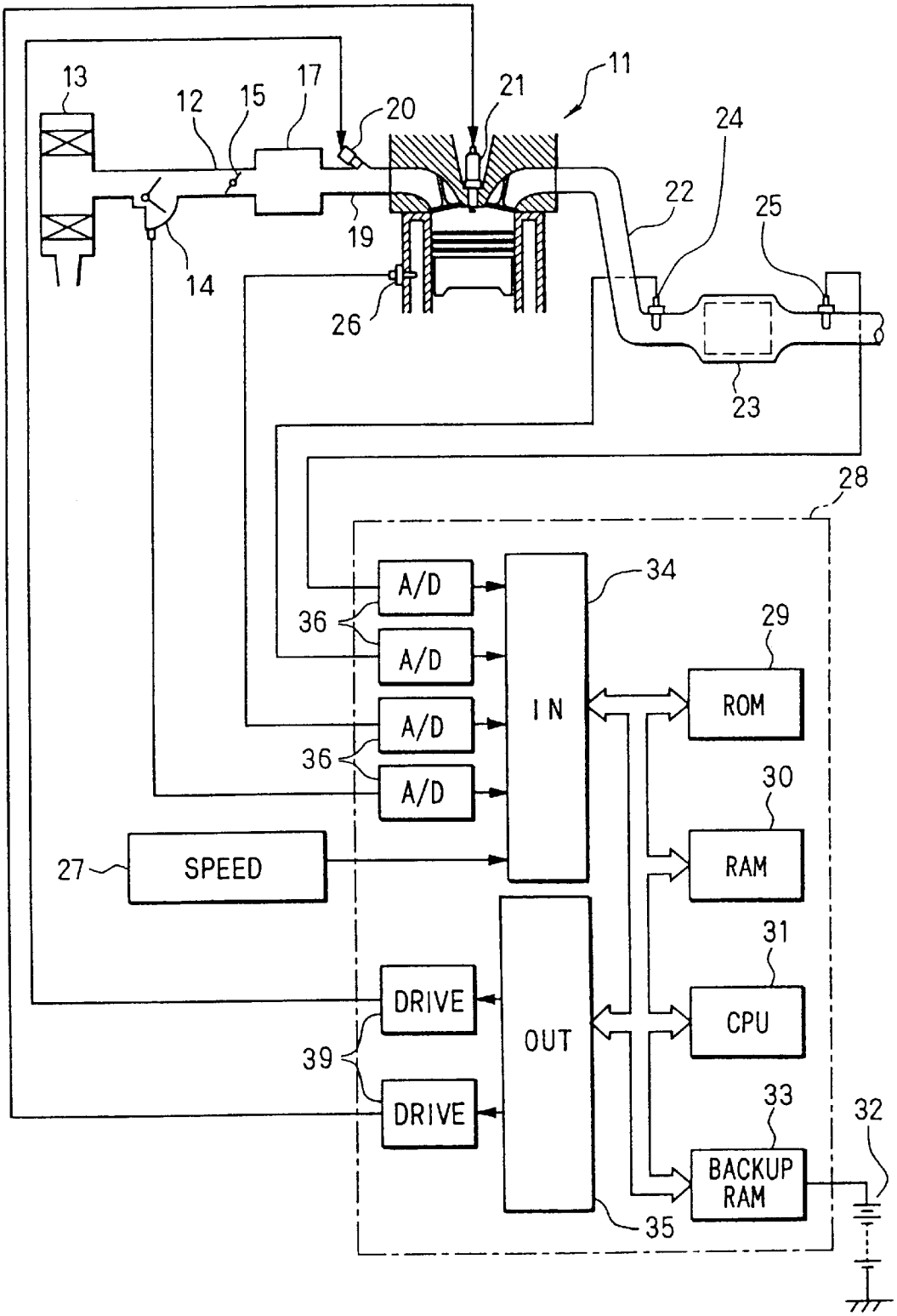
FIG. 1 is a schematic diagram showing an engine control system according to a first embodiment of the present invention.

Referring to FIG. 1, an internal combustion engine 11 has an air cleaner 13 at the upstream part of an intake pipe 12. On the downstream-side of the air cleaner 13, an air flow meter 14 for detecting an intake air volume is provided. On the downstream-side of the air flow meter 14, a throttle valve 15 is provided. Further, on the downstream-side of the throttle valve 15, a surge tank 17 is provided. The surge tank 17 is provided with an intake manifold 19 for introducing air into each of cylinder of the engine 11. A fuel injection valve 20 for injecting fuel is attached near the intake port of the intake manifold 19 of each cylinder. A spark plug 21 is attached to a cylinder head of each cylinder of the engine 11.

In midpoint of an exhaust pipe 22 of the engine 11, a catalyst 23 such as a three-way catalyst for treating CO, HC, Nox and the like in an exhaust gas is disposed. On the upstream and downstream-sides of the catalyst 23, exhaust gas sensors 24 and 25 each for detecting the air-fuel ratio, or the rich/lean state of the exhaust gas are disposed, respectively. As the upstream-side exhaust gas sensor 24, an air-fuel ratio sensor (linear A/F sensor) for outputting an air-fuel ratio signal varying linearly according to the air-fuel ratio of the exhaust gas is used. As the downstream-side exhaust gas sensor 25, an oxygen sensor is used. This output voltage is varied stepwisely according to whether the air-fuel ratio of the exhaust gas is rich or lean with respect to the stoichiometric air-fuel ratio. Thus, when the air-fuel ratio of the exhaust gas is lean, the downstream-side exhaust gas sensor 25 generates an output voltage of about 0.1 volt, whereas when the air-fuel ratio is rich, the downstream-side exhaust gas sensor 25 generates an output voltage of about 0.9 volt. A coolant water temperature sensor 26 for detecting a cooling water temperature and an engine speed sensor 27 for detecting an engine speed are provided on the cylinder block of the engine 11.

An engine control unit (ECU) 28 is constructed mainly with a microcomputer having a ROM 29, a RAM 30, a CPU 31, a backup RAM 33 backed up by a battery 32, an input port 34, and an output port 35. To the input port 34, the output signal of the engine speed sensor 27 is supplied and also output signals from the air flow meter 14, the upstream-side and downstream-side exhaust gas sensors 24 and 25, and the water temperature sensor 26 are supplied via A/D converters 36. To the output port 35, the fuel injection valve 20, the spark plug 21, and the like are connected via driving circuits 39.

The ECU 28 executes a fuel injection control and an ignition control. Programs for those controls are stored in the ROM 29 for execution by the CPU 31 so that the operations of the fuel injection valve 20 and the spark plug 21 are controlled. The ECU 28 also executes an air-ratio control program, thereby performing a feedback-control on the air-fuel ratio by controlling the fuel injection amount so that the air-fuel ratio of the exhaust gas becomes a target air-fuel ratio.

Figure 2:
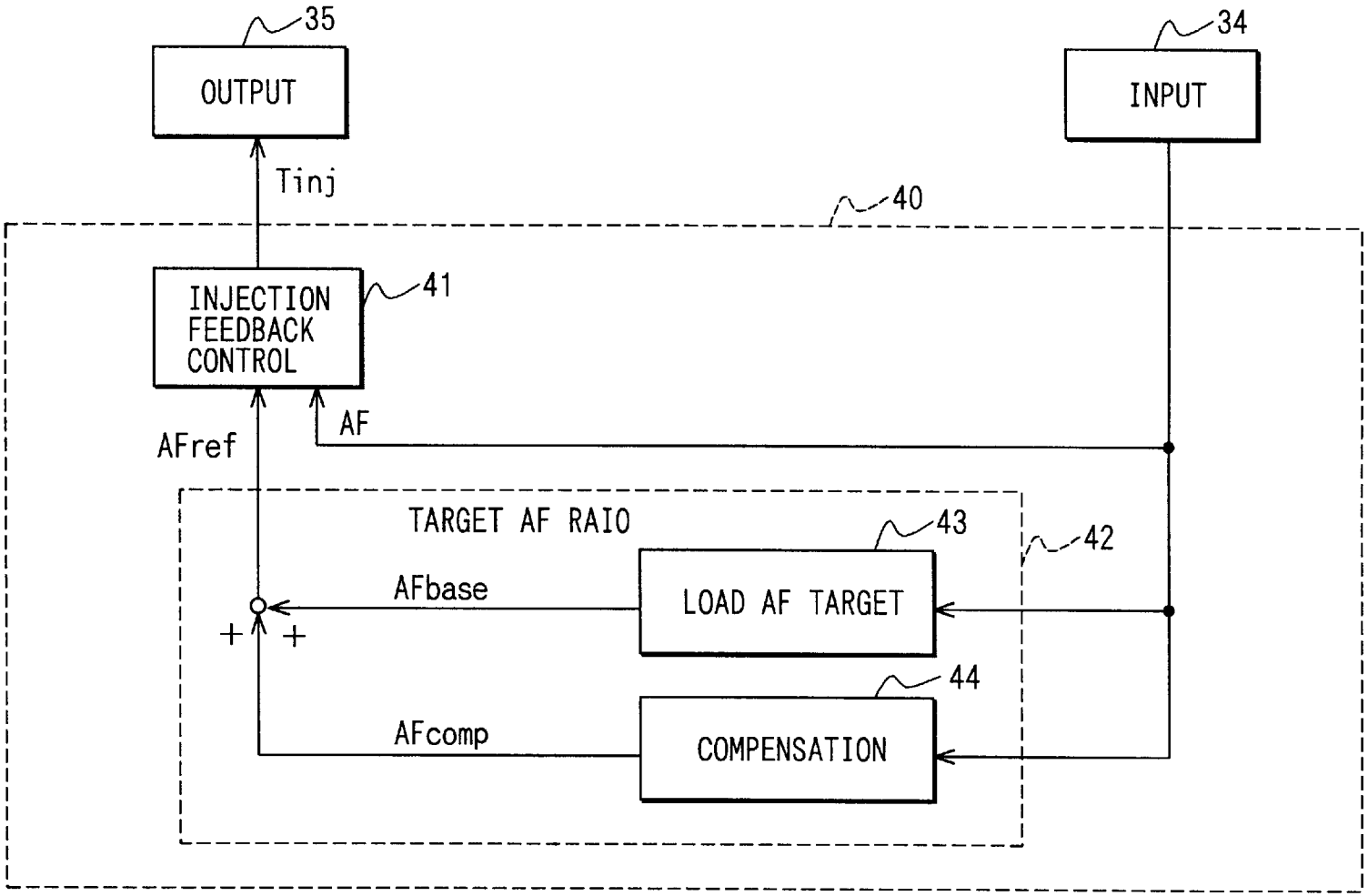
FIG. 2 is a block diagram showing an air-fuel ratio control process in the first embodiment.
Figure 3:
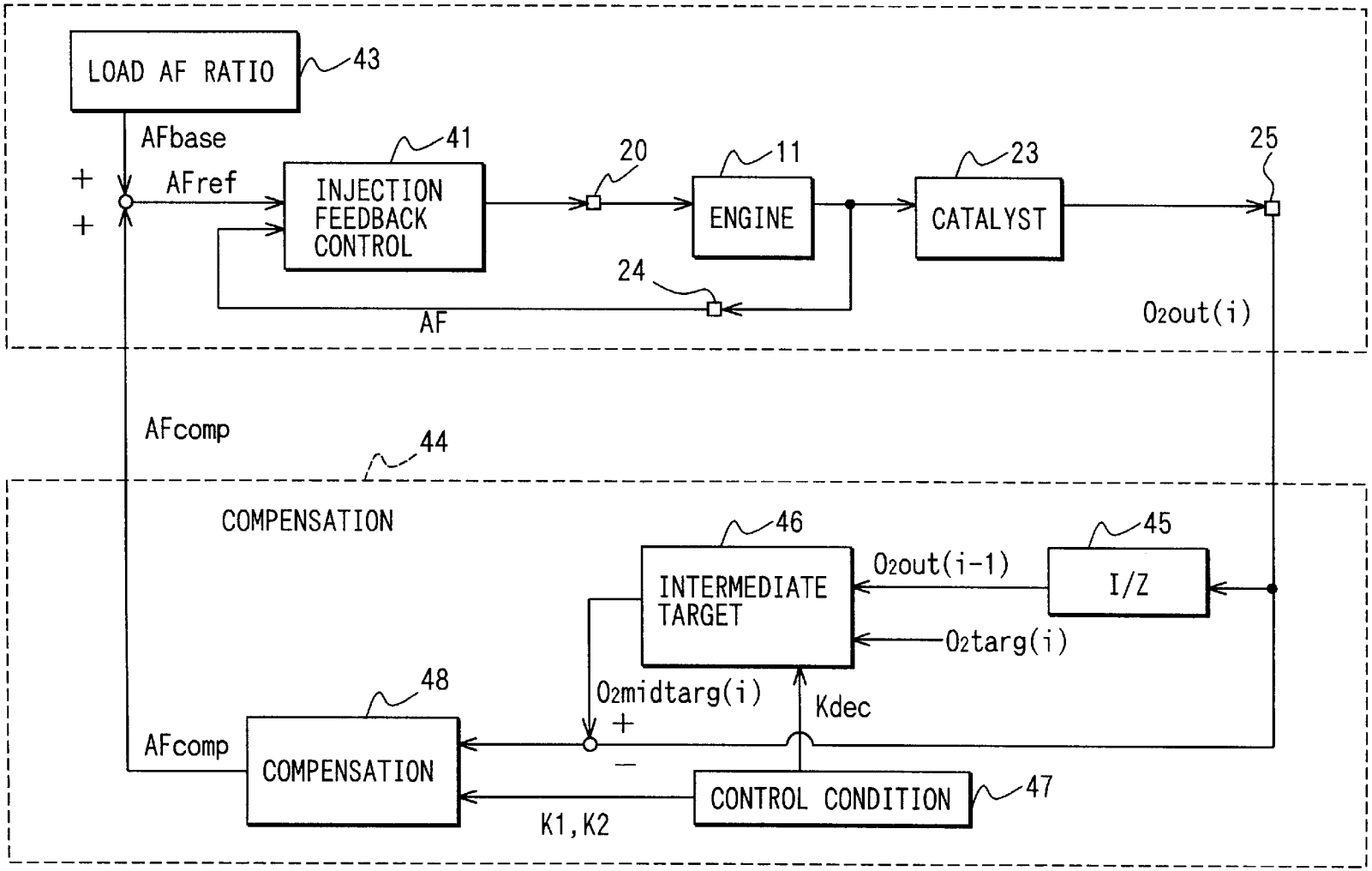
FIG. 3 is a functional block diagram showing an air-fuel ratio feedback-control process in the first embodiment.

An air-fuel ratio feedback-control will be described below with reference to FIG. 2 and FIG. 3.

An air-fuel ratio control unit 40 is constructed with a fuel injection amount feedback-control section 41 and a target air-fuel ratio calculating section. 42. The target air-fuel ratio calculating section 42 is constructed with a load target air-fuel ratio calculating section 43 and a target air-fuel ratio compensating section 44.

The fuel injection amount feedback-control section 41 calculates the fuel injection period Tinj of the fuel injection valve 20 so that the air-fuel ratio AF detected by the upstream-side exhaust gas sensor 24 converges to an upstream-side target air-fuel ratio AFref. The fuel injection period Tinj is calculated by an optimum regulator built for a linear equation of a model of the subject to be controlled.

On the other hand, the load target air-fuel ratio calculating section 43 calculates a load target air-fuel ratio AFbase according to an intake air volume (or intake manifold pressure) and the engine speed by a functional equation or a data map stored in the ROM 29. The functional equation or the map for calculating the load target air-fuel ratio AFbase is preset through experiments or the like so that, when the output value O2out (detected air-fuel ratio) of the downstream-side exhaust gas sensor 25 is steadily almost equal to a final target value O2targ (final downstream-side target air-fuel ratio), by maintaining the upstream-side target air-fuel ratio AFref at the load target air-fuel ratio AFbase, the output value O2out of the downstream-side exhaust gas sensor 25 is maintained at about the final target value O2targ.

Further, the target air-fuel ratio compensating section 44 calculates a compensation amount AFcomp of the upstream-side target air-fuel ratio AFref by using an intermediate target value O2midtarg, which will be described hereinafter, on the basis of the output value O2out of the downstream-side exhaust gas sensor 25. By adding the compensation amount AFcomp to the load target air-fuel ratio AFbase, the upstream-side target air-fuel ratio AFref is obtained, and the upstream-side target air-fuel ratio AFref is supplied to the fuel injection amount feedback control section 41.

$$AFref = AFbase + AFcomp$$

Here, in place of the above equation, the upstream-side target air-fuel ratio AFref may be also calculated as follows.

$$AFref = (1 + AFcomp) \times AFbase$$

In this case, the target air-fuel ratio calculating section 42 (the load target air-fuel ratio calculating section 43 and the target air-fuel ratio compensating section 44) corresponds to sub-feedback control means.

Next, a method of calculating the compensation amount AFcomp of the upstream-side target air-fuel ratio AFref by setting the intermediate target value O2midtarg by the target air-fuel ratio compensating section 44 will be described with reference to FIG. 3.

It is assumed that the subject to be controlled is a system including the fuel injection amount feedback control section 41, the fuel injection valve 20, the engine 11, the catalyst 23 and the downstream-side exhaust gas sensor 25. The air-fuel ratio compensation unit 44 has a time lag element (1/Z) 45, an intermediate target value calculating section 46, a control condition setting section 47 and a compensation amount calculating section 48. The time lag element 45 supplies an output O2out(i−1) of the downstream-side exhaust gas sensor 25 in computation of last time to the intermediate target value calculating section 46.

The intermediate target valve calculating unit 46 calculates an intermediate target value O2midtarg(i) on the basis of the output O2out(i−1) of the downstream-side exhaust gas sensor 25 in computation of last time and a final target value O2targ(i) (final downstream-side target air-fuel ratio) by using the following equation. By this calculation, the intermediate target value O2midtarg(i) is set between the output O2out(i−1) of the downstream-side exhaust gas sensor 25 in computation of last time and the final target value O2targ (i).

$$O2midtarg(i) = O2targ(i) + Kdec \times [O2out(i-1) - O2targ(i)]$$

In the above equation, O2targ(i) denotes a final target of this time, and O2out(i−1) expresses an output of the downstream-side exhaust gas sensor 25 in computation of last time. Kdec is an attenuating factor and is set in the range of 0<Kdec <1 by a control condition setting section 47. The attenuating factor Kdec is switched between a return control in which the catalyst 23 is returned from the state of saturated adsorption and a normal control. The attenuating factor Kdec in the return control is set at a value larger than the Kdec in the normal control and the update amount of the intermediate target value in the return control is set at a value smaller than that in the normal control. The attenuating factors Kdec in the respective control modes may be a fixed value for the purpose of simplifying a computing process, or may be set by using a data map or a mathematical expression in accordance with the engine operating conditions, the state of the catalyst 23, and the output characteristics of the downstream-side exhaust gas sensor 25.

In such a manner, the intermediate target value O2midtarg (i) is calculated by the intermediate target value calculating section 46 by the use of the attenuating factor Kdec set by the control condition setting section 47. Then the compensation amount AFcomp of the upstream-side target air-fuel ratio AFref is calculated by the following equation using the intermediate target value O2midtarg(i).

$$\begin{aligned} AFcomp(i) &= Fsat\{K1 \times (O2midtarg(i) - O2out(i)) + \\ &\quad K2 \times \sum (O2midtarg(i) - O2out(i)) \\ &= Fsat\left(K1 \times \Delta O2(i) + K2 \times \sum \Delta O2(i)\right) \end{aligned}$$

where $\Delta O2(i) = O2midtarg(i) - O2out(i)$

Figure 4:
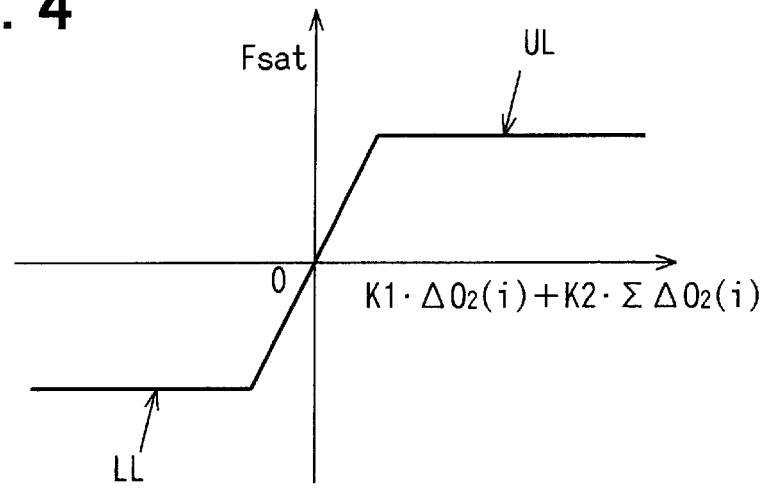
FIG. 4 is a graph showing a saturation function for calculating a compensation amount AFcomp(i) in the first embodiment.

In the above equation, Fsat denotes a saturation function having characteristics shown in FIG. 4 and the compensation amount AFcomp(i) is obtained by setting a predetermined control range (between an upper limit guard value UL and a lower limit guard value LL) for a computation value of($K1 \times \Delta O_2(i) + K2 \times \Sigma \Delta O_2(i)$). In the equation, K1 indicates a proportional gain and K2 expresses an integral gain. Consequently, $K1 \times \Delta O_2(i)$ denotes a proportional term which increases as the deviation $\Delta O_2(i)$ between the intermediate target value O2midtarg(i) and the output O2out(i) of the downstream-side exhaust gas sensor 25 becomes larger. $K2 \times \Sigma \Delta O_2(i)$ denotes an integral term which becomes larger as an integral value of the deviation $\Delta O_2(i)$ between the intermediate target value O2midtarg(i) and the output O2out (i) of the downstream-side exhaust gas sensor 25 becomes larger. The compensation amount AFcomp(i) is obtained by setting a predetermined control range (between an upper limit guard value UL and a lower limit guard value LL) for a value derived by adding the proportional term and the integral term.

In the present embodiment, the proportional gain K1, the integral gain K2 and the control range (between an upper limit guard value and a lower limit guard value) are switched between the return control in which the catalyst 23 is returned from the state of saturated adsorption and the normal state as is the case with the attenuating factor Kdec described above. The proportional gain K1 and the integral gain K2 in the return control are set at values smaller than those in the normal control and the control range (between an upper limit guard value and a lower limit guard value) in the return control is set at a range narrower than that in the normal control. The proportional gain K1, the integral gain K2 and the control range (between an upper limit guard value and a lower limit guard value) in the respective control modes may be fixed values for the purpose of simplifying a computing process, or may be set by using a map or a mathematical expression in accordance with the engine operating conditions, the state of the catalyst 23, and the output characteristics of the downstream-side exhaust gas sensor 25. Here, the control condition setting section 47 corresponds to the return control means.

The above calculation of the compensation amount AFcomp(i) by the target air-fuel ratio compensating section 44 is executed according to the respective programs in FIG. 5 to FIG. 8. Hereinafter, the processing of the respective programs will be described.

Figure 5:
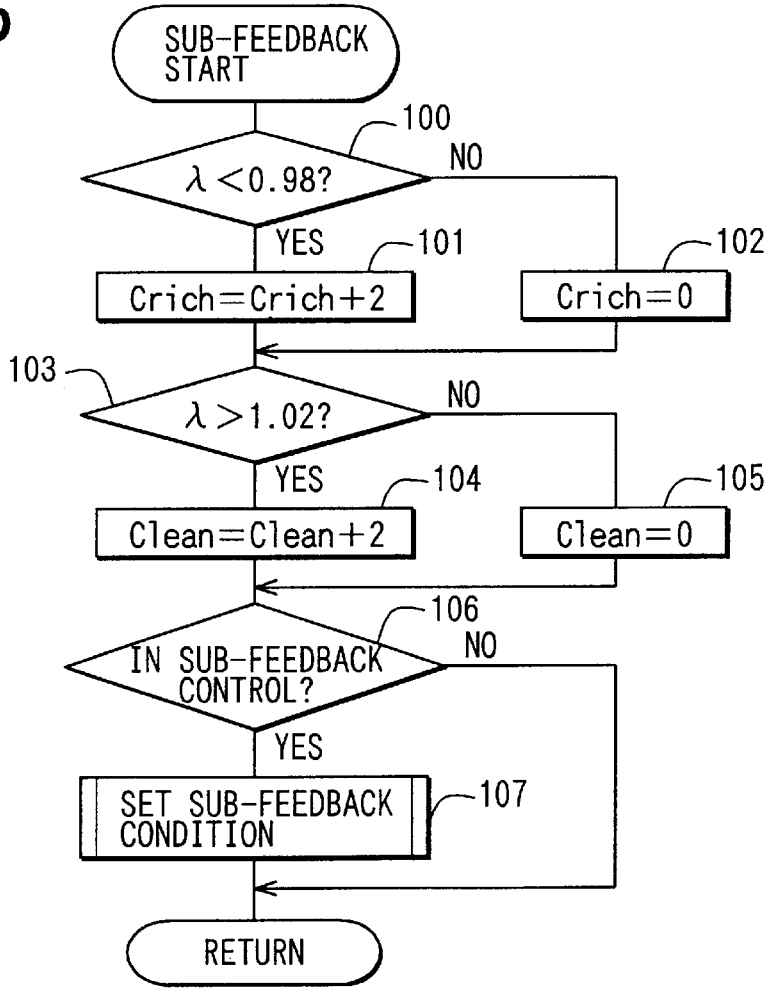
FIG. 5 is a flow diagram showing a sub-feedback control program in the first embodiment.

The sub-feedback control program in FIG. 5 is executed every predetermined time or every predetermined crankshaft rotation angle as an interrupt routine. When the program is started, first, at step 100, it is determined whether the air-fuel ratio of an air-fuel mixture supplied to the engine 11 is in a rich range (for example, $\lambda<0.98$) or not. If the air-fuel ratio is in the rich range, the processing advances to step 101 where a rich-time counter Crich for counting the time during which the air-fuel ratio remains in the rich range is incremented, for example, by two. If the air-fuel ratio is not in the rich range, the processing advances to step 102 where the rich-time counter Crich is reset to zero. The value of the rich-time counter Crich becomes information for estimating the amount of adsorption of rich components by the catalyst 23 (degree of saturated adsorption on the rich side). For example, while the engine power is being increased with more fuel, $\lambda<0.98$, the rich-time counter Crich keeps on counting up by two at predetermined intervals.

Then, the processing advances to step 103 where it is determined whether the air-fuel ratio of the air-fuel mixture supplied to the engine 11 is in a lean range (for example, $\lambda>1.02$) or not. If the air-fuel ratio is in the lean range, the processing advances to step 104 where a lean-time counter Clean for counting the time during which the air-fuel ratio remains in the lean range is incremented, for example, by two. If the air-fuel ratio is not in the lean range, the processing advances to step 105 where the lean-time counter Clean is reset to zero. The value of the lean-time counter Clean becomes information for estimating the amount of adsorption of lean components by the catalyst 23 (degree of saturated adsorption on the lean side). For example, while the fuel is being cut off, $\lambda>1.02$, the lean-time counter clean keeps on counting up by two at predetermined intervals.

Then, the processing advances to step 106 where it is determined whether the sub-feedback control is being executed or not. If the sub-feedback program is not being executed, this program is finished. If the sub-feedback program is being executed, the processing advances to step 107 where the sub-feedback condition setting program in FIG. 6 is executed to set the control conditions of the sub-feedback control in the following manner.

Figure 6:
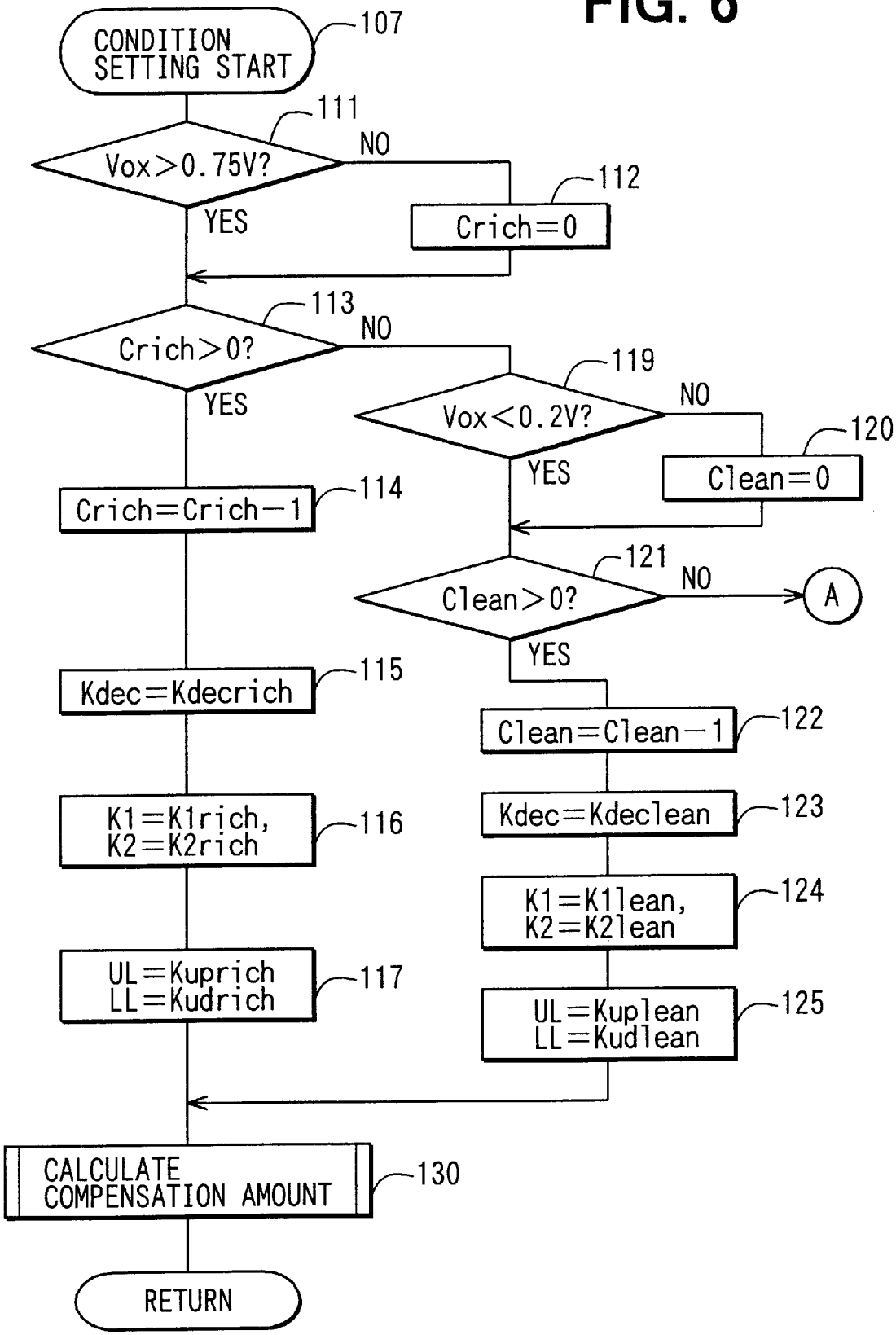
FIG. 6 is a flow diagram showing a first part of a sub-feedback condition setting program in the first embodiment.
Figure 7:
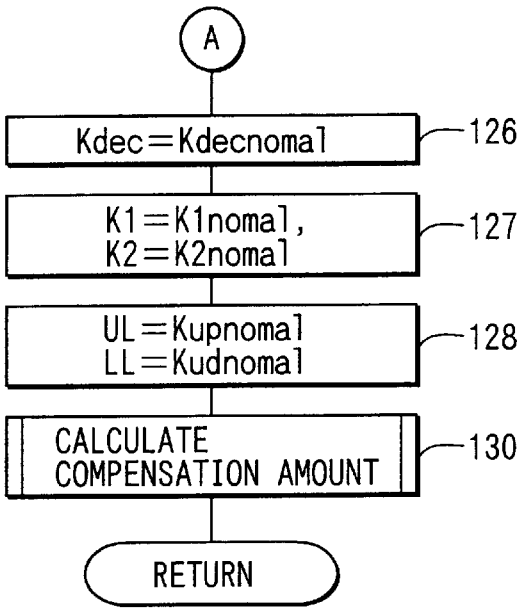
FIG. 7 is a flow diagram showing a second part of the sub-feedback condition setting program in the first embodiment.

When the sub-feedback condition setting program in FIG. 6 is started, first, at step 111, it is determined whether the output O2out of the downstream-side exhaust gas sensor 25 is more than 0.75 V or not, that is, whether the air-fuel ratio of the exhaust gas flowing out of the catalyst 23 is richer than a predetermined level or not. If the air-fuel ratio is not richer than the predetermined level, it is determined that the catalyst 23 is not in the state of a saturated adsorption on the rich side. The processing advances to step 112 where the rich-time counter Crich is reset to zero and then the processing advances to the next step 113. On the contrary, if the output O2Out of the downstream-side exhaust gas sensor 25 is not more than 0.75 V, the processing also advances to step 113.

At step 113, it is determined whether the value of the rich-time counter Crich is larger than zero or not. If the value of the rich-time counter Crich is larger than zero, a return control for returning the catalyst 23 from the state of saturated adsorption on the rich side is executed. During the return control, at step 114, the rich-time counter Crich is decremented. The processing advances to step 115 where the attenuating factor Kdec is set at a rich-side attenuating factor Kdecrich in the return control on the rich side.

Figure 8:
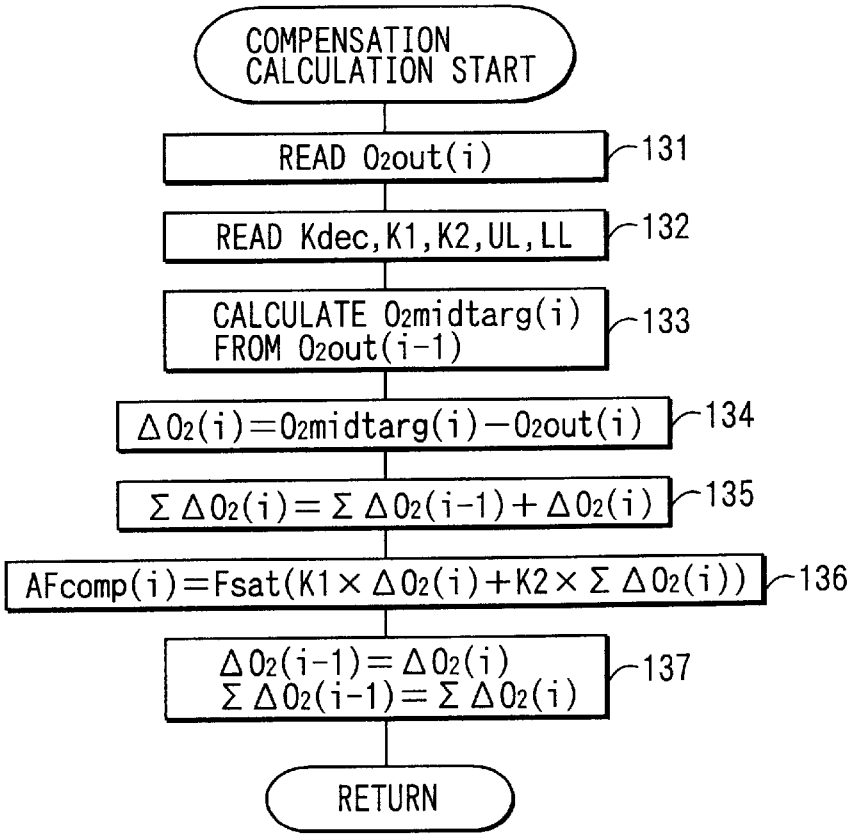
FIG. 8 is a flow diagram showing a compensation amount calculating program in the first embodiment.

Further, at the next step 116, the proportional gain K1 and the integral gain K2 are set at a proportional gain K1rich and an integral gain K2rich in the return control on the rich side. At the next step 117, the upper limit guard value and the lower limit guard value are set at an upper limit guard value Kuprich and a lower limit guard value Kudrich in the return control on the rich side. Then, the processing advances to step 130 where a compensation amount calculation program shown in FIG. 8 is executed to calculate the compensation amount AFcomp(i) of the upstream-side target air-fuel ratio AFref.

On the other hand, if it is determined at step 113 that the value of the rich-time counter is zero, the processing advances to step 119 where it is determined whether the output O2out of the downstream-side exhaust gas sensor 25 is less than 0.2 V or not, that is, whether the air-fuel ratio of the exhaust gas flowing out of the catalyst 23 is leaner than a predetermined level or not. If the air-fuel ratio of the exhaust gas flowing out of the catalyst 23 is not leaner than the predetermined level, it is determined that the catalyst 23 is not in the state of saturated adsorption on the lean side and the processing advances to step 120 where the lean-time counter Clean is rest to zero and the processing advances to step 121. On the other hand, if the output O2out of the downstream-side exhaust gas sensor 25 is not less than 0.2 V, the program also advances to step 121.

At step 121, it is determined whether the value of the lean-time counter Clean is larger than zero or not. If the value of the lean-time counter Clean is larger than zero, a return control for returning the catalyst 23 from the state of saturated adsorption on the lean side is executed. During the return control, at step 122, the lean-time counter Clean is decremented by one and the processing advances to step 123 where the attenuating factor Kdec is set at a attenuating factor Kdeclean in the return control on the lean side.

Further, at the next step 124, the proportional gain K1 and the integral gain K2 are set at a proportional gain K1lean and an integral gain K2lean in the return control on the lean side and at the next step 125, the upper limit guard value and the lower limit guard value are set at an upper limit guard vale Kuplean and a lower limit guard value Kudlean in the return control on the lean side. Then, the processing advances to step 130 where a compensation amount calculation program shown in FIG. 8 is executed to calculate the compensation amount AFcomp(i) of the upstream-side target air-fuel ratio AFref.

On the other hand, if it is determined at step 121 that the value of the lean-time counter Clean is zero, the catalyst 23 is determined as being not in the state of saturated adsorption and a normal control is executed. During the normal control, at step 126 in FIG. 7, the attenuating factor Kdec is set at a attenuating factor Kdecnormal in the normal control.

Further, at the next step 127, the proportional gain K1 and the integral gain K2 are set at a proportional gain K1normal and an integral gain K2normal in the normal control and at the next step 128, the upper limit guard value and the lower limit guard value are set at an upper limit guard vale Kupnormal and a lower limit guard value Kudnormal in the normal control. Then, the processing advances to step 130 where a compensation amount calculation program shown in FIG. 8 is executed to calculate the compensation amount AFcomp(i) of the upstream-side target air-fuel ratio AFref.

When the compensation amount calculating program shown in FIG. 8 is started, first, at step 131, the output $O_2$out(i) of this time of the downstream-side exhaust gas sensor 25 is read and at the next step 132, the attenuating factor Kdec, the proportional gain K1, the integral gain K2, the upper limit guard value UL, the lower limit guard value LL, which were set by the sub-feedback condition setting program in FIG. 6 and FIG. described above, are read.

Then, the processing advances to step 133 where, by using the attenuating factor Kdec, the intermediate target value $O_2$midtarg(i) is calculated on the basis of the output $O_2$out(i−1) of the downstream-side exhaust gas sensor 25 in computation of last time and the final target value $O_2$targ(i) (final downstream-side target air-fuel ratio) using the above equation (1). In this manner, the intermediate target value $O_2$midtarg(i) is set between the output $O_2$out(i−1) of the downstream-side exhaust gas sensor 25 in computation of last time and the final target value $O_2$targ(i).

Then, the processing advances to step 134 where the deviation $\Delta O_2(i)$ between the intermediate target value $O_2$midtarg(i) and the output $O_2$out(i) of the downstream-side exhaust gas sensor 25 is calculated.

$$\Delta O_2(i)=O_2\text{midtarg}(i)-O_2\text{out}(i)$$

At the next step 135, the integration value $\Sigma\Delta O_2(i-1)$ of the deviation $\Delta O_2$ until the previous time is integrated with the deviation $\Delta O_2$ of this time, thereby calculating the integration value $\Sigma\Delta O_2(i)$ until this time.

$$\Sigma\Delta O_2(i)=\Sigma\Delta O_2(i-1)+\Sigma\Delta O_2(i)$$

After that, the processing advances to step 136 where the compensation amount AFcomp(i) of the upstream-side target air-fuel ratio AFref is calculated by the following equation.

$$AFcomp(i)=Fsat\ (K1\times\Delta O_2(i)+K2\times\Sigma\Delta O_2(i))$$

In this manner, the compensation amount AFcomp(i) of the upstream-side target air-fuel ratio AFref is calculated by setting the upper limit guard value and the lower limit guard vale for a value obtained by adding the proportional term $(K1\times\Delta O_2(i))$ to the integral term $(K2\times\Sigma\Delta O_2(i))$. Then, at the next step 137, $\Delta O_2(i)$ and $\Sigma\Delta O_2(i)$ of this time are stored as $\Delta O_2(i-1)$ and $\Sigma\Delta O_2(i-1)$ of last time and the present program is finished.

During the operation of the engine, the load target air-fuel ratio AFbase according to the intake air volume (or intake manifold pressure) and the engine speed is calculated. The compensation amount AFcomp calculated by the compensation amount calculating program in FIG. 8 is added to the load target air-fuel ratio AFbase, thereby deriving the upstream-side target air-fuel ratio Afref. The fuel injection period Tinj (fuel injection amount) is calculated so that the air-fuel ratio AF detected by the upstream-side exhaust gas sensor 24 converges to the upstream-side target air-fuel ratio AFref.

An example of the main/sub-feedback control of the present embodiment described above will be described with reference to the timing diagram shown in FIG. 9 and FIG. 10.

Figure 9:
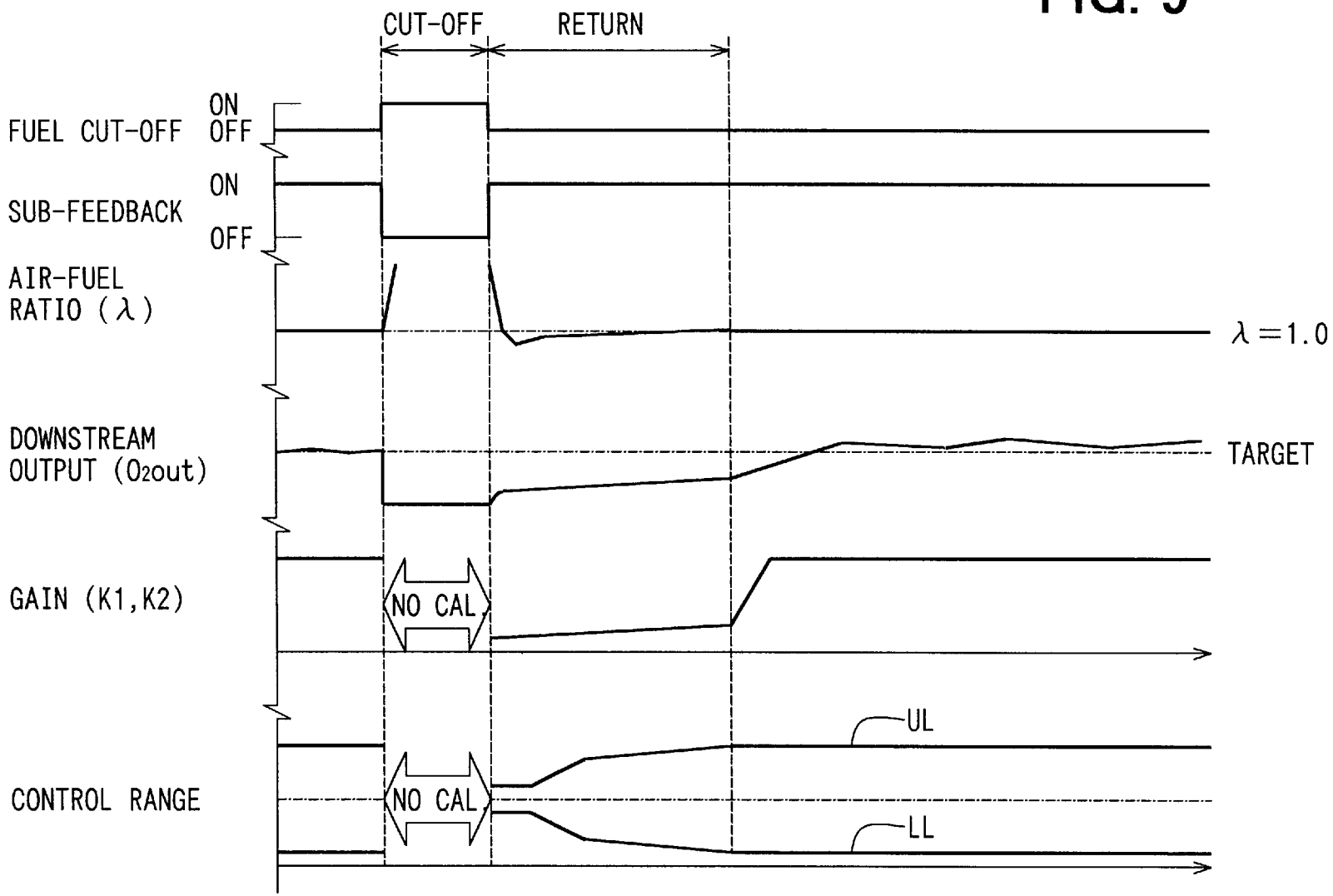
FIG. 9 is a timing diagram showing a control after return from a fuel cut-off operation in the first embodiment.

FIG. 9 shows an example of control after a return from a fuel cut-off. During the fuel cut-off, the execution conditions of the feedback-control are not satisfied and the calculation of the attenuating factor Kdec, the proportional gain K1, the integral gain K2, the upper limit guard value UL and the lower limit guard value LL is stopped. If the fuel cut-off is executed, the amount of adsorption of lean components by the catalyst 23 becomes a saturated state. Thus, immediately after a return from the fuel cut-off, a return control for returning the catalyst 23 from the state of saturated adsorption on the lean side is executed. In this return control on the lean side, the attenuating factor Kdec, the proportional gain K1, the integral gain K2, the upper limit guard value UL and the lower limit guard value LL are set at the respective values in the return control on the lean side. In this manner, the update amount of the intermediate target value in the return control is made smaller than that in the normal control and the compensation amount AFcomp of the upstream-side target air-fuel ratio AFref by the sub-feedback control in the return control is set at a value smaller than that in the normal control. During the return control, the attenuating factor Kdec, the proportional gain K1, the integral gain K2, the upper limit guard value and the lower limit guard value are gradually brought near to the values in the normal control according to the lapse of in time in the return control (that is, according to the degree of recovery of the catalyst 23).

In this manner, when the catalyst 23 is returned from the state of saturated adsorption on the lean side to the state of small amount of adsorption after the return from the fuel cut-off, even if the storage state of the catalyst 23 is unstable, the sub-feedback control can be stably executed by limiting the control condition of the sub-feedback control within the range of ensuring stability. Thereby, the performance of cleaning the exhaust gas after the return from the fuel cut-off can be ensured.

The execution time of the return control is set in accordance with the execution time of fuel cut-off counted by the lean-time counter Clean and after the setting time elapses, the return control is finished and is moved to the normal control. Even before the setting time elapses, when the output of the downstream-side exhaust gas sensor 25 becomes not less than 0.2 V, it is determined that the catalyst 23 is returned to the state in which the amount of adsorption of lean components by the catalyst 23 is small, and the return control is finished and is moved to the normal control.

In the normal control, the attenuating factor Kdec, the proportional gain K1, the integral gain K2, the upper limit guard value and the lower limit guard value are switched to the respective values in the normal control. Thereby, the update amount of the intermediate target value is made larger than that in the return control and the compensation amount AFcomp of the upstream-side target air-fuel ratio AFref by the sub-feedback control is made larger than that in the return control. In this manner, in the normal control, the sub-feedback control having fast response to a change in the dynamic characteristics of the catalyst 23 is executed to enhance the performance of cleaning the exhaust gas to the maximum.

Figure 10:
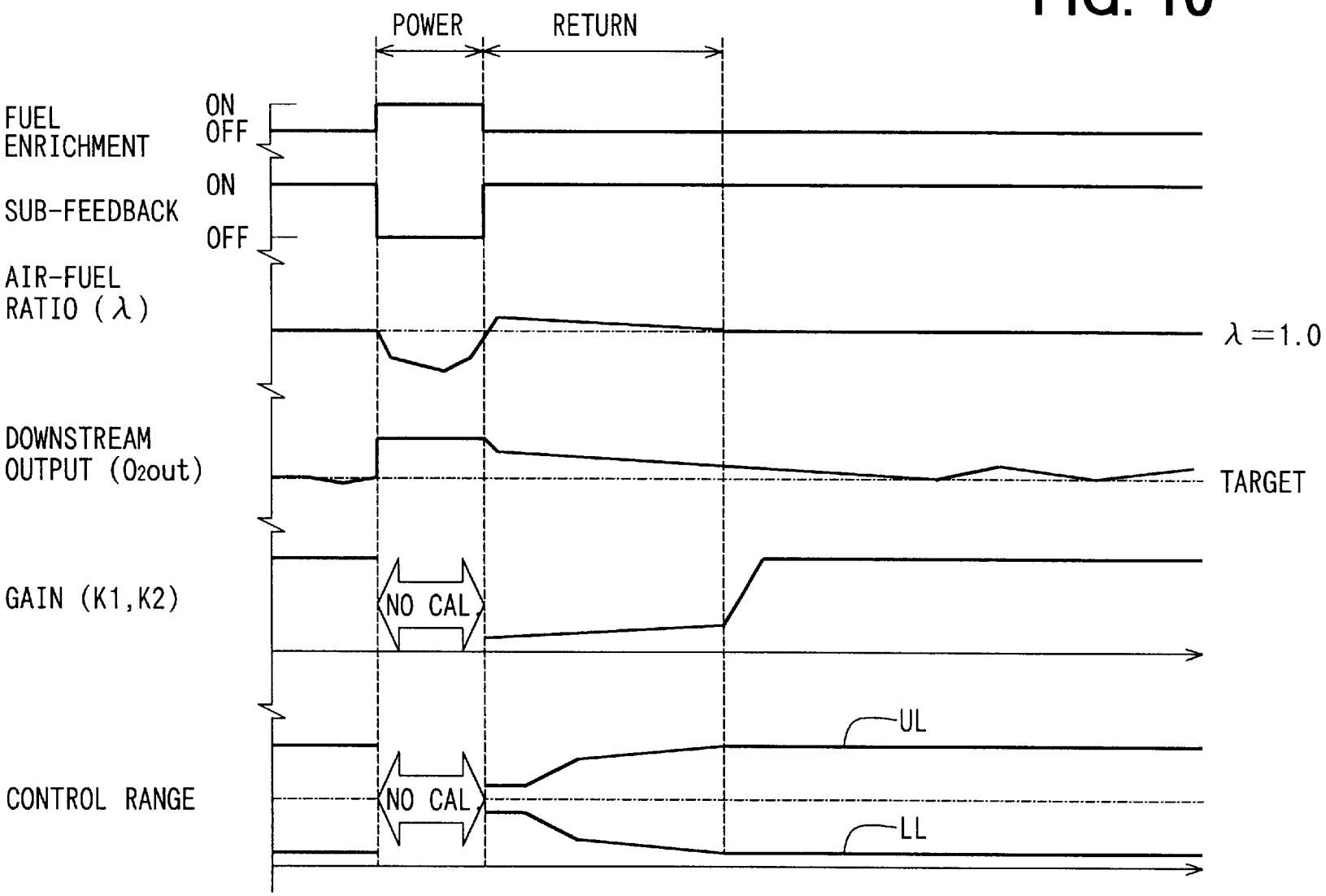
FIG. 10 is a timing diagram showing a control after return from a power increasing operation in the first embodiment.

On the other hand, FIG. 10 shows an example of control after the return from fuel enrichment (fuel-rich air-fuel mixture) for increasing engine power. During increasing the power, the execution conditions of the sub-feedback control do not hold and the calculation of the attenuating factor Kdec, the proportional gain K1, the integral gain K2, the upper limit guard value UL and the lower limit guard value LL is stopped. After increasing the power, the amount of adsorption of rich components by the catalyst 23 becomes a saturated state. Thus, immediately after the return from increasing the power, a return control for returning the catalyst 23 from the state of saturated adsorption on the rich side is executed. In the return control on the rich side, the attenuating factor Kdec, the proportional gain K1, the integral gain K2, the upper limit guard value UL and the lower limit guard value LL are set at values in the return control on the rich side. In this manner, the update amount of the intermediate target value in the return control is made smaller than that in the normal control, and the compensation amount AFcomp of the upstream-side target air-fuel ratio AFref by the sub-feedback control in the return control is made smaller than that in the normal control.

In this manner, when the catalyst 23 is returned from the state of saturated adsorption on the rich side after the return from increasing the power, even if the storage state of the catalyst 23 is unstable, the sub-feedback control can be stably executed by limiting the control condition of the sub-feedback control within the range of ensuring stability. Whereby the performance of cleaning the exhaust gas after the return from increasing the power can be ensured.

The execution time of the return control is set in accordance with the execution time of increasing the power counted by the rich-time counter Crich and after the setting time elapses, the return control is finished and is moved to the normal control. Even before the setting time elapses, when the output of the downstream-side exhaust gas sensor 25 becomes not more than 0.75 V, for example, it is determined that the catalyst 23 is returned to the state in which the amount of adsorption of rich components is small and the return control is finished and is moved to the normal control.

In this respect, although the control conditions of the return control on the lean side and on the rich side are set at different conditions according to the characteristics of the catalyst 23 and the output characteristics of the downstream-side exhaust gas sensor 25 in the above embodiment, the control conditions of the return control on the lean side and on the rich side may be set at the same conditions for the purpose of simplifying a computation processing.

Further, in the above embodiment, in the return control, all of the attenuating factor Kdec, the proportional gain K1, the integral gain K2, the control range (the upper limit guard value UL and the lower limit guard value LL) are changed to those in the return control, but only a part of them may be changed.

Still further, in the above embodiment, the update amount of the intermediate target value O2midtarg(i) is updated by changing the attenuating factor Kdec in the return control and the normal control, but the update amount of the intermediate target value O2midtarg(i) may be changed by the other method, or the update period (update rate) of the intermediate target value O2midtarg(i) may be changed in the return control and in the normal control.

Still further, the intermediate target value O2midtarg(i) may be calculated by a two-dimensional data map having the output O2out(i−1) of the downstream-side exhaust gas sensor 25 of preceding computation time and the final target value O2targ(i) as parameters. In this case, it is recommended that the intermediate target value calculating map for the return control and the intermediate target value calculating map for the normal control be set by an experiment or a simulation.

The control period (computation period of the compensation amount AFcomp) of the sub-feedback control may be changed in the return control and in the normal control.

Further, in the above embodiment, it is determined whether the catalyst 23 becomes the state of saturated adsorption or not by whether the output voltage of the downstream-side exhaust gas sensor 25 is, for example, more than 0.7 V or less than 0.2 V. However, it may be determined that the catalyst 23 becomes the state of saturated adsorption when the fuel cut-off is executed. It may also be determined whether the catalyst 23 becomes the state of saturated adsorption or nor by whether the state in which the output voltage of the downstream-side exhaust gas sensor 25 is more than a predetermined rich voltage or less than a predetermined lean voltage lasts for a predetermined period or not.

Second Embodiment

Figure 11:
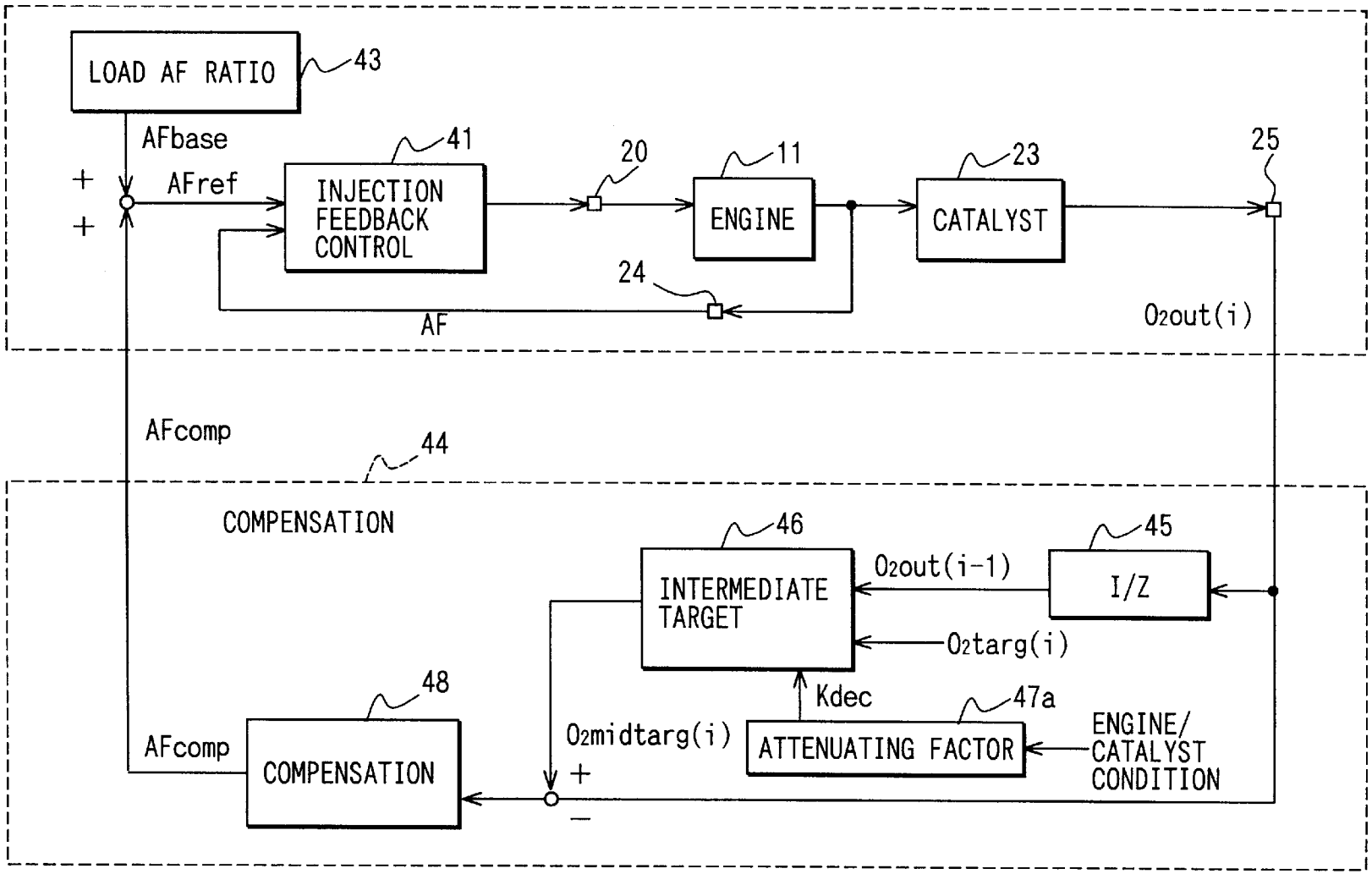
FIG. 11 is a functional block diagram showing an air-fuel ratio feedback control according to a second embodiment of the present invention.

In the second embodiment, as shown in FIG. 11, an attenuating factor setting section 47*a* is provided. The attenuating factor setting section 47*a* sets the attenuating factor Kdec in the range of 0<Kdec <1 according to parameters relating to the state of operation of the engine or the state of the catalyst 23. Here, it is recommended that the parameter relating to the state of the operation of the engine includes one or a plurality of parameters of, for example, an exhaust gas flow, an intake air amount, an engine speed, an intake manifold pressure, a throttle opening, a vehicle speed, a cooling water temperature, an exhaust gas temperature, an idle switch signal, and a lapse of time after starting the engine. Further, it is recommended that the parameters relating to the state of the catalyst 23 includes one or a plurality of parameters of a catalyst reaction rate, a catalyst temperature (capable of being replaced by the exhaust gas temperature or the lapse of time after starting the engine), the degree of deterioration of the catalyst 23, and the storage amount of $O_2$ (amount of adsorption of lean/rich components) by the catalyst 23.

In the present embodiment, in consideration of the fact that delay system (dead time and time constant) by the catalyst 23 are largely varied by the exhaust gas flow and the catalyst reaction rate, the attenuating factor setting section

Figure 12:
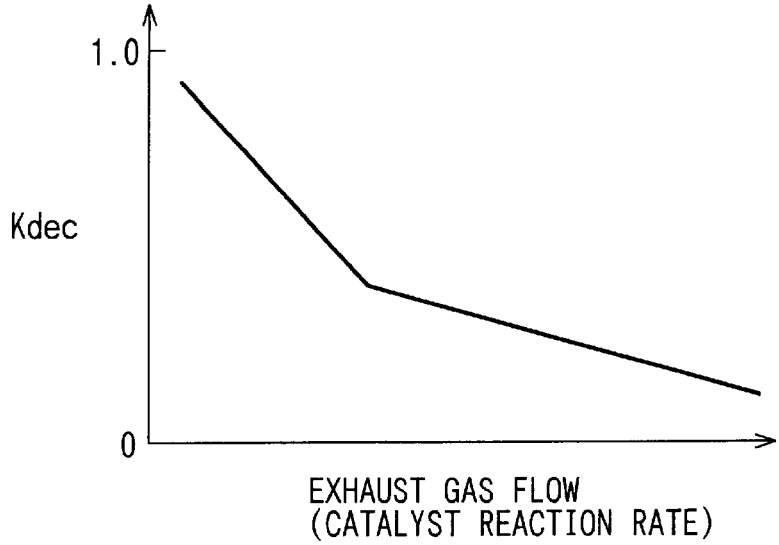
FIG. 12 is a graph showing a data map for setting a attenuating factor Kdec according to an exhaust gas flow (or catalyst reaction rate) in the second embodiment.

47*a* sets the attenuating factor Kdec according to the parameter relating to the exhaust gas flow and the catalyst reaction rate by a data map shown in FIG. 12 or a mathematical expression. Here, it is recommended that the parameter relating to the exhaust gas flow includes one or a plurality of parameters of the intake air volume, the engine speed, the intake manifold pressure and the throttle opening. Of course, the exhaust gas flow may be calculated from these parameters. Further, it is recommended that the parameters relating to the catalyst reaction rate includes one or a plurality of parameters of a catalyst temperature (capable of being replaced by the exhaust gas temperature or the lapse of time after starting the engine), the degree of deterioration of the catalyst 23, and the storage amount of $O_2$ (amount of adsorption of lean/rich components) by the catalyst 23. Of course, the catalyst reaction rate may be calculated from these parameters.

The characteristics of an attenuating factor setting map shown in FIG. 12 are set in such as way that as exhaust gas flow becomes smaller (catalyst reaction rate becomes slower), the attenuating factor Kdec becomes larger and the update amount of the intermediate target value O2midtarg(i) becomes larger, and that as the exhaust gas flow becomes larger (catalyst reaction rate becomes faster), the attenuating factor Kdec becomes smaller and the update amount of the intermediate target value O2midtarg(i) becomes smaller so as to prevent fluctuation.

Also in the present embodiment, as in the case with the first embodiment, the intermediate target value calculating section 46 calculates the intermediate target value O2midtarg(i) by the use of the attenuating factor Kdec set by the attenuating factor setting section 47*a*, and then the compensation amount AFcomp(i) of the upstream-side target air-fuel ratio AFref is calculated by the following equation using the intermediate target value O2midtarg(i).

$$\begin{aligned} AFcomp(i) &= Fsat\{K1 \times (O2midtarg(i) - O2out(i)) + \\ &\quad K2 \times \Sigma(O2midtarg(i) - O2out(i)) \\ &= Fsat(K1 \times \Delta O2(i) + K2 \times \Sigma\Delta O2(i)) \end{aligned}$$

where $\Delta O_2(i) \times O_2midtarg(i) - O_2out(i)$

Figure 13:
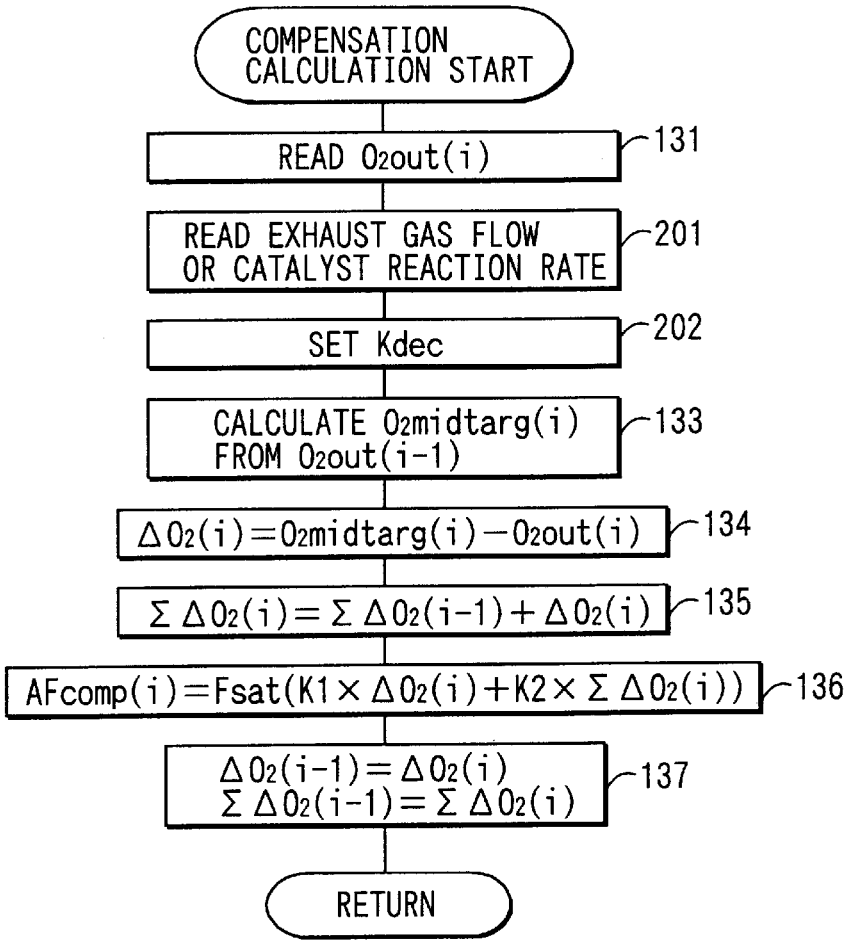
FIG. 13 is a flow diagram showing a compensation amount calculating program in the second embodiment.

The calculation of the compensation amount AFcomp(i) by the target air-fuel ratio compensating section 44 is performed by the compensation amount calculating program in FIG. 13. This program is executed every predetermined period or every predetermined crankshaft rotation angle. Unlike the first embodiment, in the present program, step 201 and step 202 are executed. That is, at step 131, the present output O2out(i) of the downstream-side exhaust gas sensor 25 is read, and at the following step 201, parameters relating to the exhaust gas flow or the catalyst reaction rate are read.

Here, it is recommended that the parameter relating to the exhaust gas flow includes one or a plurality of parameters of the intake air volume, the engine speed, the intake manifold pressure and the throttle opening. Of course, the exhaust gas flow may be calculated from these parameters. Further, it is recommended that as the parameter relating to the catalyst reaction rate includes one or a plurality of parameters of a catalyst reaction rate, a catalyst temperature (capable of being replaced by the exhaust gas temperature or the lapse of time after starting the engine), the degree of deterioration of the catalyst 23, and the storage amount of $O_2$ (amount of adsorption of lean/rich components) by the catalyst 23. Of course, the catalyst reaction rate may be calculated from these parameters.

After that, at step 202, the attenuating factor Kdec is set by the map in FIG. 12 or the mathematical expression according to the parameters relating to the exhaust gas flow or the catalyst reaction rate. Thereafter, as is the case with the first embodiment, steps from 133 to 137 are executed.

During the operation of the engine, the load target air-fuel ratio AFbase is calculated according to the intake air volume (or intake manifold pressure) and the engine speed, and by adding the compensation amount AFcomp calculated by the compensation amount calculating program shown in FIG. 13 to the load target air-fuel ratio AFbase, the upstream-side target air-fuel ratio AFref and the fuel injection period Tinj (fuel injection amount) is calculated so that the air-fuel ratio AF detected by the upstream-side exhaust gas sensor 24 converges to the upstream-side target air-fuel ratio AFref.

According to the second embodiment described above, in consideration of the fact that delay system (dead time and time constant) by the catalyst 23 are largely varied by the exhaust gas flow and the catalyst reaction rate, the attenuating factor Kdec is changed according to the parameters relating to the exhaust gas flow and the catalyst reaction rate to change the update amount of the intermediate target value O2midtarg (i). Thus, the sub-feedback control having fast response to a change in delay system (dead time and time constant) by the catalyst 23 can be stably performed to ensure the stable performance of cleaning the exhaust gas not affected by the state of operation of the engine and the state of the catalyst 23.

While the update amount of the intermediate target value O2midtarg(i) is changed by changing the attenuating factor Kdec, the update amount of the intermediate target value O2midtarg(i) may be changed by the other method, or the update period (update rate) of the intermediate target value O2midtarg(i) may be also changed according to parameters relating to the exhaust gas flow or the catalyst reaction rate.

Third Embodiment

Figure 14:
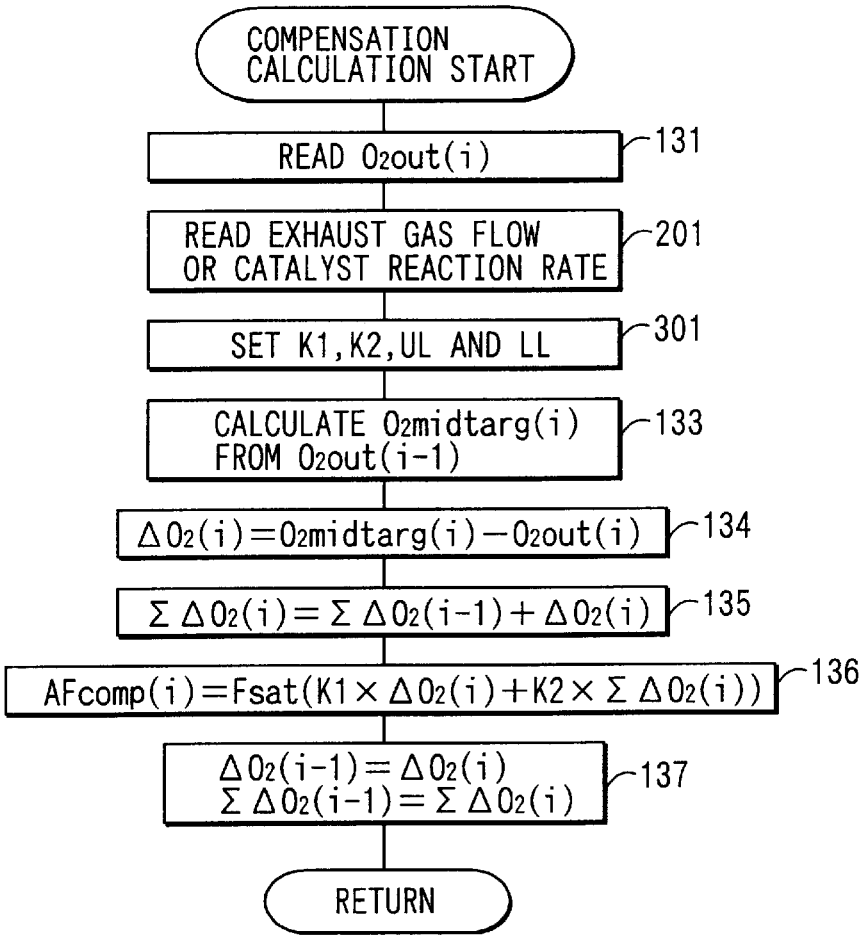
FIG. 14 is a flow diagram showing a compensation amount calculating program according to a third embodiment of the present invention.
Figure 15:
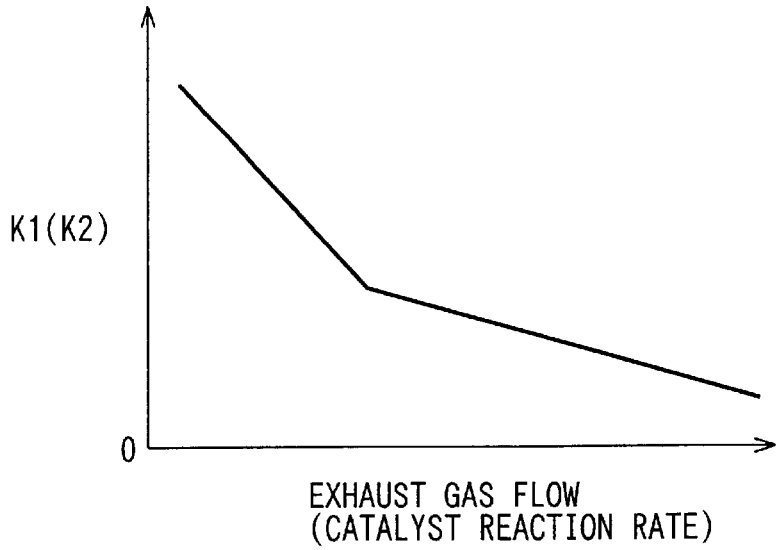
FIG. 15 is a graph showing a data map for setting a proportional gain K1 (integral K2) according to an exhaust gas flow (or catalyst reaction rate) in the third embodiment.
Figure 16:
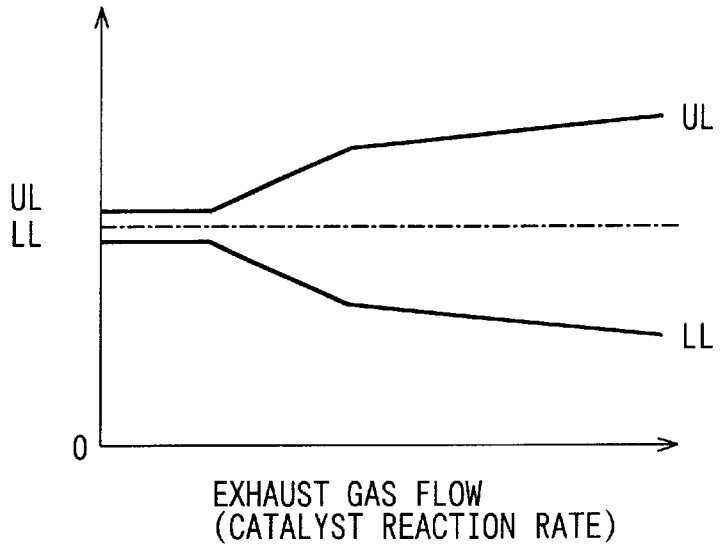
FIG. 16 is a graph showing a data map for setting a control range according to an exhaust gas flow (or catalyst reaction rate) in the third embodiment.

In the third embodiment, as shown in FIGS. 14 to 16, by changing the proportional gain K1, the integral gain K2, and the control range (the upper limit guard value UL and the lower limit guard value LL) according to parameters relating to the exhaust gas flow or the catalyst reaction rate, the sub-feedback control is made to respond to a change in the delay system (dead time and time constant) by the catalyst 23.

The characteristic of a data map for changing the proportional gain K1 (integral gain K2), shown in FIG. 14, is set in such a way that as the exhaust gas flow becomes smaller (catalyst reaction rate becomes slower), the proportional gain K1 (integral gain K2) becomes larger and the control speed becomes faster and that as the exhaust gas flow becomes larger (catalyst reaction rate becomes faster), the proportional gain K1 (integral gain K2) becomes smaller and the control speed becomes smaller so as to prevent fluctuation.

The characteristic of the data map for changing the control range (the upper limit guard value UL and the lower limit guard value LL), shown in FIG. 15, is set in such a way that as exhaust gas flow becomes smaller (catalyst reaction rate becomes slower), the control range becomes narrower and that as the exhaust gas flow becomes larger (catalyst reaction rate becomes faster), the control range becomes wider.

In the compensation amount calculating program used in the present embodiment and shown in FIG. 14, step 202 of the compensation amount calculating program shown in FIG. 13 of the second embodiment is changed to step 301 and the other steps are the same as those in the compensation amount calculating program shown in FIG. 13 of the second embodiment. In this compensation amount calculating program, at step 201, the parameters relating to the exhaust gas flow or the catalyst reaction rate are read and then the processing advances to step 301 where the proportional gain K1, the integral gain K2, and the control range (the upper limit guard value UL and the lower limit guard value LL) are changed according to the parameters relating to the exhaust gas flow or the catalyst reaction rate by the maps in FIG. 15 and FIG. 16.

Then, the intermediate target value O2midtarg(i) is calculated on the basis of the output O2out(i−1) of the downstream-side exhaust gas sensor 25 of preceding computation time and the final target value O2targ(i), and then the compensation amount AFcomp(i) of the upstream-side target air-fuel ratio AFref is calculated by the use of the proportional gain K1, the integral gain K2, and the control range (the upper limit guard value and the lower limit guard value), which are set at step 301 (steps 133 to 137).

In this respect, the attenuating factor Kdec may be a fixed value for the purpose of simplifying the computing process. Further, the intermediate target value O2midtarg(i) may be calculated by a two-dimensional data map having the output O2out(i−1) of the downstream-side exhaust gas sensor 25 of preceding computation time and the final target value O2targ (i) as parameters.

As described above, also by changing the proportional gain K1, the integral gain K2, and the control range (upper limit guard value UL and the lower limit guard value LL) according to the parameters relating to the exhaust gas flow or the catalyst reaction rate, as is the case with the second embodiment, the sub-feedback control having fast response to a change in delay system (dead time and time constant) by the catalyst 23 can be stably performed to ensure the stable performance of cleaning the exhaust gas not affected by the state of operation of the engine and the state of the catalyst 23.

The control period of the sub-feedback control (computation period of the compensation amount AFcomp (i)) may be also changed according to parameters relating to the exhaust gas flow or the catalyst reaction rate.

Further, at least one of the update amount of the intermediate target value, the update rate, the control gain of the sub-feedback control, the control period, the control range may be changed by the use of the parameters not related to the exhaust gas flow and the catalyst reaction rate.

Fourth Embodiment

The fourth embodiment is also constructed in the same way as the second and third embodiments. That is, the attenuating factor setting section 47*a* in FIG. 11 sets the attenuating factor Kdec in the range of 0<Kdec<1 according to the output O2out(i) of the downstream-side exhaust gas sensor 25 by the use of an attenuating factor setting data map in FIG. 18.

Figure 18:
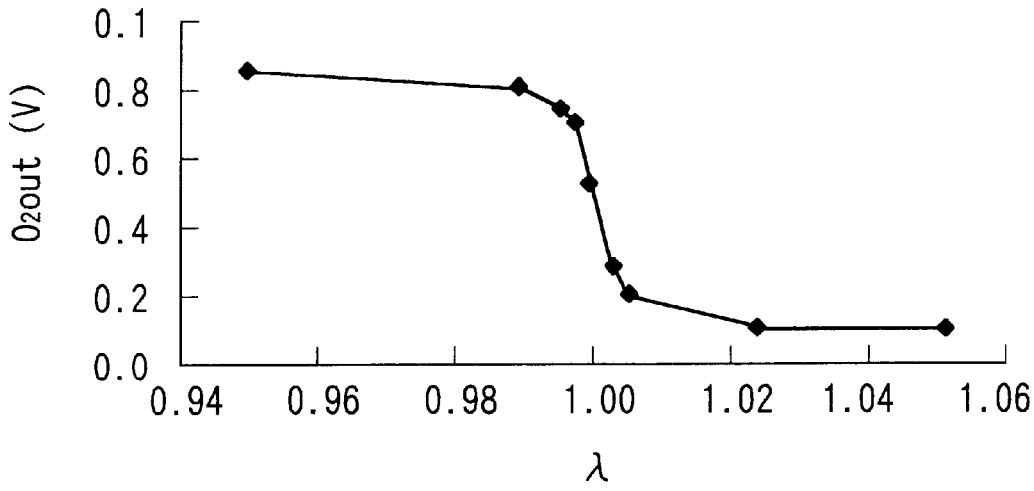
FIG. 18 is a graph showing the output characteristics of a downstream-side exhaust gas sensor in the fourth embodiment.
Figure 19:
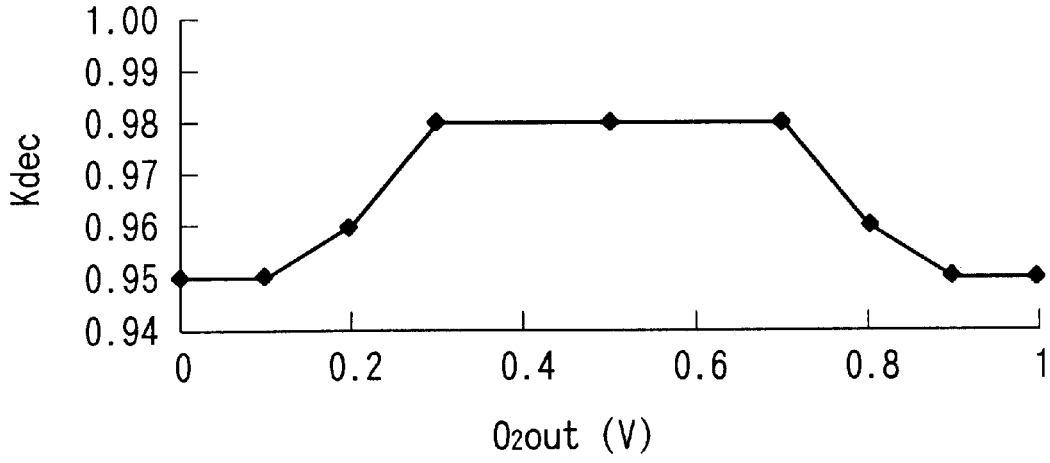
FIG. 19 is a graph showing a data map for setting a attenuating factor Kdec in the fourth embodiment.

The characteristic of the attenuating factor setting map in FIG. 18 is set in such a way that in order to compensate the effect of the Z-type output characteristic of the downstream-side exhaust gas sensor (oxygen sensor) 25. It is considered that a change in the output voltage of the downstream-side exhaust gas sensor 25 with respect to a change in the air-fuel ratio is steep. In the region near the stoichiometric air-fuel ratio (from 0.3 V to 0.7 V), the attenuating factor Kdec becomes a maximum value (for example, 0.98). In the rich region of more than 0.7 v and the lean region of less than 0.3 V, it is considered that a change in the output voltage of the downstream-side exhaust gas sensor 25 with respect to a change in the air-fuel ratio is small. Thus, the attenuating factor Kdec becomes smaller as the degree of rich or lean state becomes higher. Here, the attenuating factor setting section 47 corresponds to control compensation means.

In such a manner, in the attenuating factor setting section 47*a*, the intermediate target value O2midtarg(i) is calculated by the intermediate target value calculating section 46 by the use of the attenuating factor Kdec set according to the output O2out(i) of the downstream-side exhaust gas senor 25. Then, the compensation amount AFcomp(i) of the upstream-side target air-fuel ratio AFref is calculated by the following equation using this intermediate target value O2midtarg(i).

$$\begin{aligned} AFfcomp(i) &= Fsat\{K1 \times (O2midtarg(i) - O2out(i)) + \\ &\quad K2 \times \Sigma(O2midtarg(i) - O2out(i)) \\ &= Fsat(K1 \times \Delta O2(i) + K2 \times \Sigma\Delta O2(i)) \end{aligned}$$

where $\Delta O_2(i) = O_2midtarg(i) - O_2out(i)$

In the above equation, Fsat denotes a saturation function having characteristics as shown in FIG. 4 and the compensation amount AFcomp(i) is obtained by setting the upper limit guard value and the lower limit guard value for the computation value of $(K1 \times \Delta O_2(i) + K2 \times \Sigma\Delta O_2(i))$.

Figure 17:
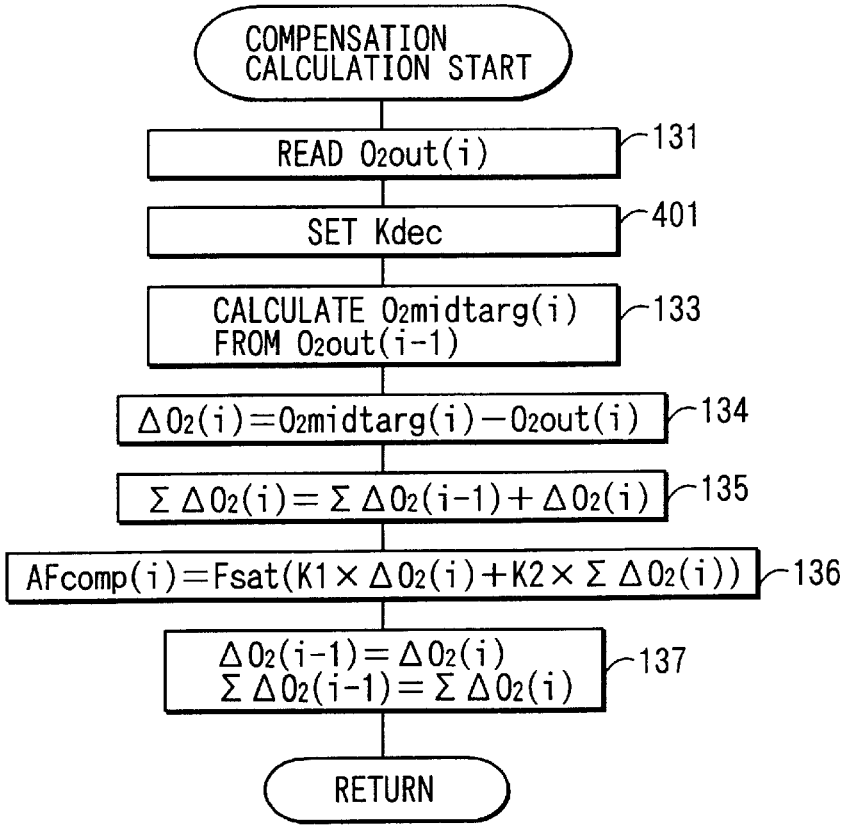
FIG. 17 is a flow diagram showing a compensation amount calculating program according to a fourth embodiment of the present invention.

The calculation of the compensation amount AFcomp(i) by the target air-fuel ratio compensating section 44, is executed by the compensation amount calculating program shown in FIG. 17. This program is executed every predetermined period or every predetermined crank angle. When the program is started, first, at step 131, the present output O2out(i) of the downstream-side exhaust gas sensor 25 is read and at the next step 401, the attenuating factor Kdec is set according to the present output O2out(i) of the downstream-side exhaust gas sensor 25 by the use of the attenuating factor setting map in FIG. 18 or the mathematical equation. After that, as described above, steps 133 to 137 are executed.

According to this embodiment, since the attenuating factor Kdec is set at a maximum value in the region where the air-fuel ratio of the exhaust gas is close to the stoichiometric air-fuel ratio ($\lambda$=1.00), considering that a change in the output voltage of the downstream-side exhaust gas sensor 25 with respect to a change in air-fuel ratio is steep, it is possible to prevent the update amount of the intermediate target value O2midtarg(i) from becoming excessively large with respect to a change in the air-fuel ratio and to prevent fluctuation and thus to improve the stability of the sub-feedback control near the stoichiometric air-fuel ratio. Further, since the attenuating factor Kdec is set in such a way that it becomes smaller as the degree of rich or lean state becomes higher, considering that a change in the output voltage of the downstream-side exhaust gas sensor 25 with respect to a change in the air-fuel ratio is small in the rich region or in the lean region, it is possible to increase the update amount of the intermediate target value O2midtarg(i) so as to respond to the amount of change in the actual air-fuel ratio and to make the sub-feedback control well respond to a change in the air-fuel ratio and thus to reduce exhaust emission in the rich region and in the lean region.

Therefore, even if the output characteristic of the downstream-side exhaust gas sensor 25 is not linear, by suitably changing the attenuating factor Kdec so as to compensate the effect of the output characteristic, it is possible to perform the sub-feedback control having good performance in both response and stability and to ensure stable exhaust gas cleaning performance not affected by the output characteristic of the downstream-side exhaust gas sensor 25.

In this connection, while the update amount of the intermediate target value O2midtarg(i) is changed by changing the attenuating factor Kdec, the update amount of the intermediate target value O2midtarg(i) may be changed by a method other than this method. Alternatively, the update period (update rate) of the intermediate target value O2midtarg(i) may be changed according to the output of the downstream-side exhaust gas sensor 25.

Fifth Embodiment

In this embodiment, by changing the proportional gain K1 and the integral gain K2 according to the output of the downstream-side exhaust gas sensor 25, the output characteristic of the downstream-side exhaust gas sensor 25 can be compensated.

Figure 21:
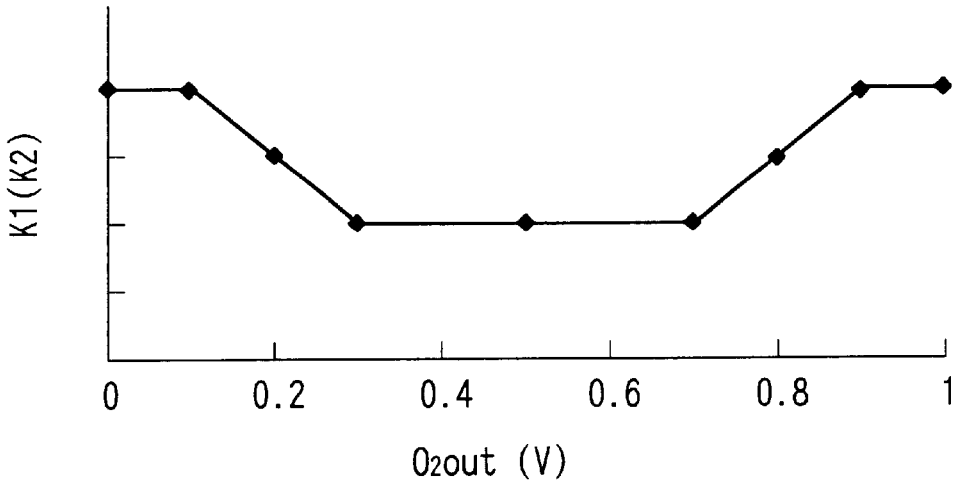
FIG. 21 is a graph showing a data map for setting a proportional gain K1 (integral K2) according to the output of a downstream-side exhaust gas sensor in the fourth embodiment.

The characteristic of a data map for changing the proportional gain K1 (integral gain K2) in FIG. 21 is set in such a way that the proportional gain K1 (integral gain K2) becomes a minimum value in the region near the stoichiometric air-fuel ratio (from 0.3 to 0.7 V). It is considered that a change in the output voltage of the downstream-side exhaust gas sensor 25 with respect to a change in the air-fuel ratio is steep. In the rich region of more than 0.7 V and the lean region of less than 0.3 V, it is considered that a change in the output voltage of the downstream-side exhaust gas sensor 25 with respect to a change in the air-fuel ratio is small. Thus, the proportional gain K1 (integral gain K2) becomes larger as the degree of rich or lean state becomes higher.

In the compensation amount calculating program of the present embodiment, step 401 of the compensation amount calculating program, shown in FIG. 17, in the fourth embodiment is changed to step 501 and the respective steps except for step 501 are the same as those in the compensation amount calculating program in the fourth embodiment. In the present compensation amount calculating program, at step 131, the present output O2out(i) of the downstream-side exhaust gas sensor 25 is read. Then, the processing advances to step 501 where the proportional gain K1 and the integral gain K2 are changed by the map in FIG. 21 according to the present output O2out(i) of the downstream-side exhaust gas sensor 25. Then, the intermediate target value O2midtarg(i) is calculated on the basis of the output O2out(i−1) of the downstream-side exhaust gas sensor 25 of preceding computation time and the final target value O2targ(i). Then, the compensation amount AFcomp(i) of the upstream-side target air-fuel ratio AFref is calculated by the use of the proportional gain K1 and the integral gain K2, which are set at step 501 (steps 133 to 137).

In this respect, the attenuating factor Kdec may be a fixed value for the purpose of simplifying the computing process. Further, the intermediate target value O2midtarg(i) may be calculated by the two-dimensional map having the output O2out(i−1) of the downstream-side exhaust gas sensor 25 of preceding computation time and the final target value O2targ (i) as parameters.

According to the present embodiment, by changing the proportional gain K1 and the integral gain K2 in accordance with the output O2out(i−1) of the downstream-side exhaust gas sensor 25, it is possible to change the proportional gain K1 and the integral gain K2 so as to suitably compensate the effect of the output characteristic of the downstream-side exhaust gas sensor 25, which makes it possible to conduct the sub-feedback control having good performance in both response and stability and to ensure the stable performance of cleaning the exhaust gas not affected by the output characteristic of the downstream-side exhaust gas sensor 25.

Sixth Embodiment

In this embodiment, by changing the control range (the upper limit guard value UL and the lower limit guard value LL) according to the output of the downstream-side exhaust gas sensor 25, the output characteristic of the downstream-side exhaust gas sensor 25 is compensated.

Figure 23:
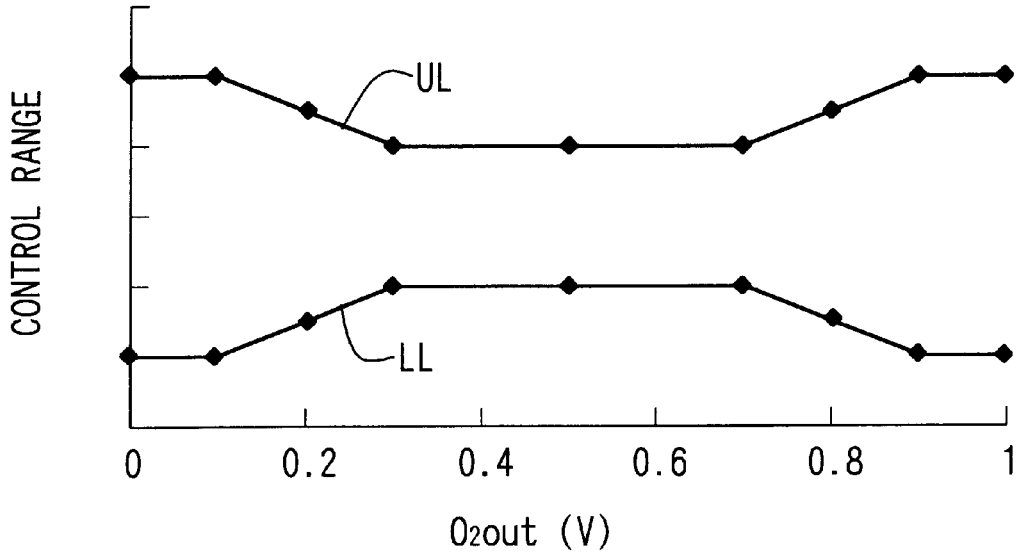
FIG. 23 is a graph showing a data map for setting a control range according to the output of a downstream-side exhaust gas sensor in the sixth embodiment.

The characteristic of a data map for changing the control range in FIG. 23 is set in such a way that the control range (the upper limit guard value UL and the lower limit guard value LL) becomes the narrowest in a region near the stoichiometric air-fuel ratio (from 0.3 V to 0.7 V). It is considered that a change in the output voltage of the downstream-side exhaust gas sensor 25 with respect to a change in the air-fuel ratio is steep. In the rich region of more than 0.7 V and the lean region of less than 0.3 V, it is considered that a change in the output voltage of the downstream-side exhaust gas sensor 25 with respect to a change in the air-fuel ratio is small. Thus, the control range (the upper limit guard value UL and the lower limit guard value LL) becomes wider as the degree of rich or lean state becomes higher.

Figure 20:
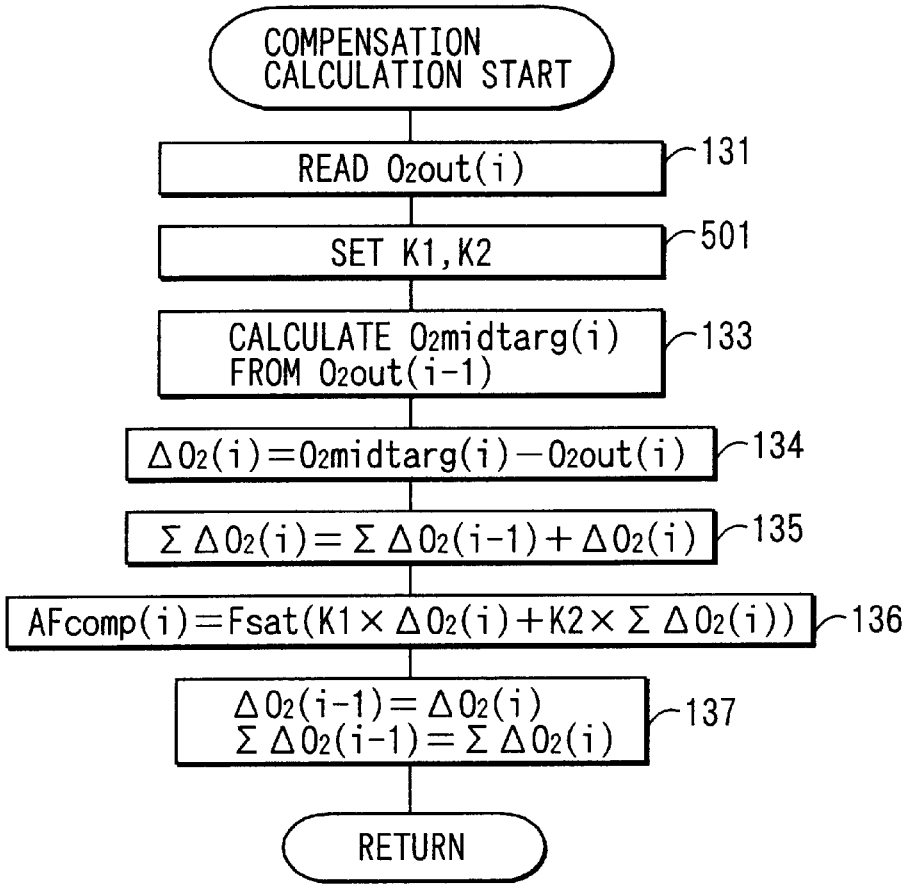
FIG. 20 is a flow diagram showing a compensation amount calculating program according to a fifth embodiment of the present invention.
Figure 22:
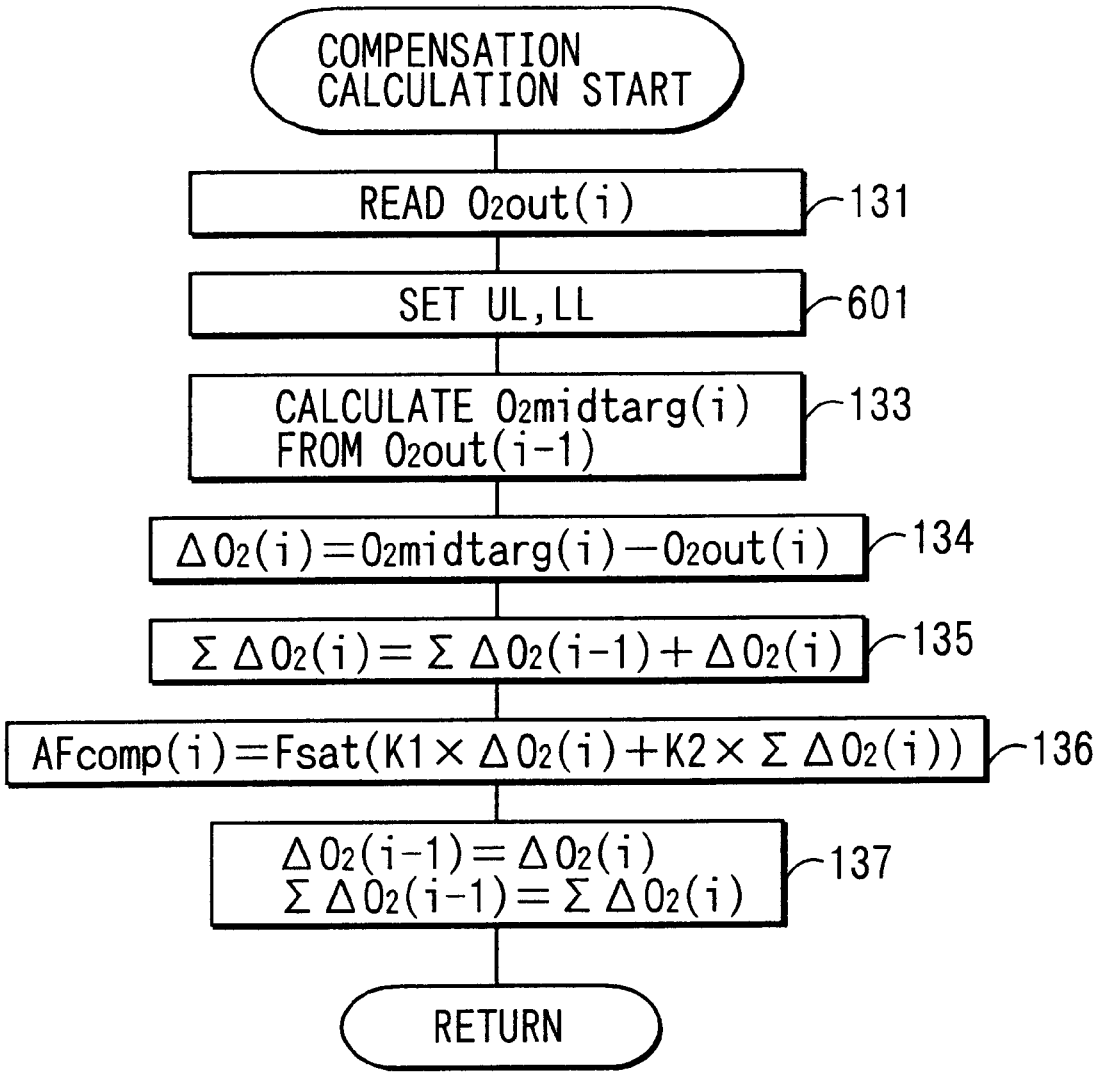
FIG. 22 is a flow diagram showing a compensation amount calculating program according to a sixth embodiment of the present invention.

In the compensation amount calculating program in FIG. 22, step 501 of the compensation amount calculating program shown in FIG. 20 is changed to step 601 and the respective steps except for step 601 are the same as those in the compensation amount calculating program in FIG. 20. In the present compensation amount calculating program, at step 131, the present output O2out(i) of the downstream-side exhaust gas sensor 25 is read. Then, the processing advances to step 601 where the control range (the upper limit guard value UL and the lower limit guard value LL) is changed by the data map in FIG. 23 according to the present output O2out(i) of the downstream-side exhaust gas sensor 25. Then, the intermediate target value O2midtarg(i) is calculated on the basis of the output O2out(i−1) of the downstream-side exhaust gas sensor 25 of preceding computation time and the final target value O2targ(i) and then the compensation amount AFcomp(i) of the upstream-side target air-fuel ratio AFref is calculated by the use of the control range (the upper limit guard value UL and the lower limit guard value LL) set at step 601 described above (steps 133 to 137).

In this respect, also in the present embodiment, the attenuating factor Kdec may be a fixed value for the purpose of simplifying the computing process. Further, the intermediate target value O2midtarg(i) may be calculated by the two-dimensional map having the output O2out(i−1) of the downstream-side exhaust gas sensor 25 of preceding computation time and the final target value O2targ(i) as parameters.

According to the present embodiment, by changing the control range (the upper limit guard value UL and the lower limit guard value LL) in accordance with the output of the downstream-side exhaust gas sensor 25, the control range (the upper limit guard value and the lower limit guard value) can be changed so as to suitably compensate the effect of the output characteristic of the downstream-side exhaust gas sensor 25, which makes it possible to conduct the sub-feedback control having good performance in both response and stability and to ensure a stable performance of cleaning the exhaust gas not affected by the output characteristic of the downstream-side exhaust gas sensor 25.

Further, the control period of the sub-feedback control (computation period of the compensation amount AFcomp (i)) may be varied according to the output of the downstream-side exhaust gas sensor 25.

Seventh Embodiment

Figure 24:
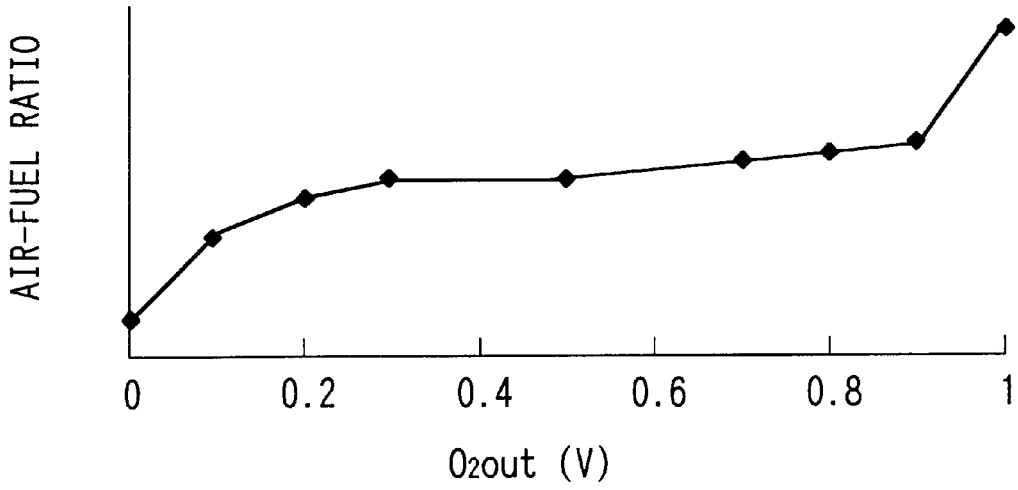
FIG. 24 is a graph showing a data map for linearizing the output of a downstream-side exhaust gas sensor according to the output characteristics of the downstream-side exhaust gas sensor according to a seventh embodiment of the present invention.

In the seventh embodiment, an air-fuel ratio value is determined by linearizing the output of the downstream-side exhaust gas sensor 25 by the use of a data map shown in FIG. 24 according to the output characteristic of the downstream-side exhaust gas sensor 25. The intermediate target value is calculated by the use of thus determined air-fuel ratio value. In this manner, even if the output characteristic of the downstream-side exhaust gas sensor 25 is a Z-type characteristic, it is possible to calculate the intermediate target value by using the detected air-fuel ratio value obtained by converting the output characteristic of the downstream-side exhaust gas sensor 25 (detection characteristic of the air-fuel ratio) into a linear characteristic. Therefore, it is possible to conduct the sub-feedback control having good response and stability by compensating the effect of the output characteristic of the downstream-side exhaust gas sensor 25 and to ensure a stable performance of cleaning exhaust gas not affected by the output characteristic of the downstream-side exhaust gas sensor 25.

Eighth Embodiment

In the eighth embodiment, the intermediate target value set on the basis of the past output of the downstream-side exhaust gas sensor 25 and the final target value is corrected according to the output characteristic of the downstream-side exhaust gas sensor 25. The the sub-feedback control is conducted by using the corrected intermediate target value. Also in this manner, it is possible-to conduct the sub-feedback control having good response and stability by compensating the effect of the output characteristic of the downstream-side exhaust gas sensor 25 and to ensure a stable performance of cleaning exhaust gas not affected by the output characteristic of the downstream-side exhaust gas sensor 25.

In the above embodiments, as to the downstream-side exhaust gas sensor 25, an air-fuel ratio sensor (linear A/F sensor) may be used in place of the oxygen sensor, and as to the upstream-side exhaust gas sensor 24, an oxygen sensor may be used in place of the air-fuel ratio sensor (linear A/F sensor).

Still further, when the intermediate target value O2midtarg(i) is calculated, the output O2out(i−1) of the downstream-side exhaust gas sensor 25 of preceding computation time is used. However, the output O2out(i−1) of the downstream-side exhaust gas sensor 25 in computation of a predetermined number of times ago may be used.

In addition, it is of course that the present invention can be put into practice in various modifications: for example, the calculation equation of the intermediate target value O2midtarg(i) and the calculation equation of the compensation amount can be modified, if necessary.

What is claimed is:

1. An air-fuel ratio control apparatus for an internal combustion engine having a catalyst comprising:

an upstream-side exhaust gas sensor and a downstream-side exhaust gas sensor for detecting an air-fuel ratio or a rich/lean state of an exhaust gas at an upstream-side and a downstream-side of the catalyst for cleaning the exhaust gas, respectively;

air-fuel ratio feedback control means for feedback-controlling a fuel injection amount so that an air-fuel ratio detected by the upstream-side exhaust gas sensor becomes equal to an upstream-side target air-fuel ratio;

intermediate target value setting means for setting an intermediate target value on the basis of an air-fuel ratio previously detected by the downstream-side exhaust gas sensor and a final downstream-side target air-fuel ratio;

sub-feedback control means for performing a sub-feedback control for correcting the upstream-side target air-fuel ratio on the basis of the air-fuel ratio detected by the downstream-side exhaust gas sensor and the intermediate target value; and return control means which performs, for a predetermined period of time, a return control for varying at least one of an update amount and an update rate of the intermediate target value, and a control gain, a control period and a control range of the sub-feedback control, when the catalyst is returned from a state of saturated adsorption.

2. The air-fuel ratio control apparatus as in claim 1, wherein the intermediate target value setting means determines the intermediate target value by adding the final downstream-side target air-fuel ratio and a value, which is obtained by multiplying a deviation between the air-fuel ratio previously detected by the downstream-side exhaust gas sensor and the final downstream-side target air-fuel ratio by an attenuating factor, and wherein the return control means varies the attenuating factor in the return control.

3. The air-fuel ratio control apparatus as in claim 1, wherein the sub-feedback control means determines a compensation amount of the upstream-side target air-fuel ratio by limiting a value, which is obtained by performing a proportional and integral operation to a deviation between the air-fuel ratio detected by the downstream-side gas sensor and the intermediate target value, within a predetermined control range, and wherein the return control means varies the gain of the proportional and integral operation and/or the control range.

4. The air-fuel ratio control apparatus as in claim 1, wherein the return control means sets a period of time for performing the return control according to a period of time during which the rich or lean state continues where the catalyst becomes the state of saturated adsorption.

5. The air-fuel ratio control apparatus as in claim 1, wherein the return control means determines a timing at which the return control is finished and returned to a normal control on the basis of the air-fuel ratio detected by the downstream-side exhaust gas sensor.

6. The air-fuel ratio control apparatus as in claim 1, wherein the return control means determines that the catalyst becomes the state of saturated adsorption when a fuel cut-off is performed.

7. An air-fuel ratio control apparatus for an internal combustion engine having a catalyst comprising:

an upstream-side exhaust gas sensor and a downstream-side exhaust gas sensor for detecting an air-fuel ratio or a rich/lean state of an exhaust gas at an upstream-side and a downstream-side of the catalyst for cleaning the exhaust gas, respectively;

air-fuel ratio feedback control means for feedback-controlling a fuel injection amount so that an air-fuel ratio detected by the upstream-side exhaust gas sensor becomes equal to an upstream-side target air-fuel ratio;

intermediate target value setting means for setting an intermediate target value on the basis of an air-fuel ratio previously detected by the downstream-side exhaust gas sensor and a final downstream-side target air-fuel ratio;

sub-feedback control means for performing a sub-feedback control for correcting the upstream-side target air-fuel ratio on the basis of the air-fuel ratio detected by the downstream-side exhaust gas sensor and the intermediate target value; and control compensation means for varying at least one of an update amount and an update rate of the intermediate target value, and a control gain, a control period and a control range of the sub-feedback control, according to a parameter relating to at least one of a state of operation of the internal combustion engine and a state of the catalyst.

8. The air-fuel ratio control apparatus as in claim 7, wherein the control compensation means varies at least one of the update amount and the update rate of the intermediate target value, and the control gain, the control period and the control range of the sub-feedback control.

9. The air-fuel ratio control apparatus as in claim 7, wherein the intermediate target value setting means determines the intermediate target value by adding a value, obtained by multiplying the deviation between the air-fuel ratio previously detected by the downstream-side exhaust gas sensor and the final downstream-side target air-fuel ratio by an attenuating factor, and the final downstream-side target air-fuel ratio, and wherein the control compensation means varies the attenuating factor according to the parameter.

10. The air-fuel ratio control apparatus as in claim 7, wherein the sub-feedback control means determines the compensation amount of the upstream-side target air-fuel ratio by limiting a value, which is obtained by performing a proportional and integral operation to a deviation between the air-fuel ratio detected by the downstream-side gas sensor and the intermediate target value, within a predetermined control range, and wherein the control compensation means varies at least one of the gain of the proportional and integral operation and the control range according to-the parameter.

11. An air-fuel ratio control apparatus for an internal combustion engine having a catalyst comprising:

an upstream-side exhaust gas sensor and a downstream-side exhaust gas sensor for detecting an air-fuel ratio or a rich/lean state of an exhaust gas at an upstream-side and a downstream-side of the catalyst for cleaning the exhaust gas, respectively;

air-fuel ratio feedback control means for feedback-controlling a fuel injection amount so that an air-fuel ratio detected by the upstream-side exhaust gas sensor becomes equal to an upstream-side target air-fuel ratio;

intermediate target value setting means for setting an intermediate target value on the basis of an air-fuel ratio previously detected by the downstream-side exhaust gas sensor and a final downstream-side target air-fuel ratio;

sub-feedback control means for performing a sub-feedback control for correcting the upstream-side target air-fuel ratio on the basis of the air-fuel ratio detected by the downstream-side exhaust gas sensor and the intermediate target value; and control compensation means for varying at least one of an update amount and an update rate of the intermediate target value, and a control gain, a control period and a control range of the sub-feedback control, according to the output of the downstream-side exhaust gas sensor.

12. The air-fuel ratio control apparatus as in claim 11, wherein the intermediate target value setting means determines the intermediate target value by adding a value, obtained by multiplying a deviation between the air-fuel ratio previously detected by the downstream-side exhaust gas sensor and a final downstream-side target air-fuel ratio by an attenuating factor, and the final downstream-side target air-fuel ratio, and wherein the control compensation means varies the attenuating factor according to the output of the downstream-side exhaust gas sensor.

13. The air-fuel ratio control apparatus as in claim 11, wherein the sub-feedback control means determines the compensation amount of the upstream-side target air-fuel ratio by limiting a value, which is obtained by performing a proportional and integral operation to a deviation between the air-fuel ratio detected by the downstream-side gas sensor and the intermediate target value, within a predetermined control range, and wherein the control compensation means varies at least one of the gain of the proportional and integral operation and the control range according to a parameter relating to the output of the downstream-side exhaust gas sensor.

14. An air-fuel ratio control apparatus for an internal combustion engine having a catalyst, comprising:

an upstream-side exhaust gas sensor and a downstream-side exhaust gas sensor for detecting an air-fuel ratio or a rich/lean state of an exhaust gas at an upstream-side and a downstream-side of the catalyst for cleaning an exhaust gas, respectively;

air-fuel ratio feedback-control means for feedback-controlling a fuel injection amount so that the air-fuel ratio detected by the upstream-side exhaust gas sensor becomes an upstream-side target air-fuel ratio;

intermediate target value setting means for setting an intermediate target value on the basis of an air-fuel ratio previously detected by the downstream-side exhaust gas sensor and a final downstream-side target air-fuel ratio;

sub-feedback control means for performing a sub-feedback control for correcting the upstream-side target air-fuel ratio on the basis of the air-fuel ratio detected by the downstream-side exhaust gas sensor and the intermediate target value; and linearizing means for determining an air-fuel ratio detection value by linearizing the output of the downstream-side exhaust gas sensor according to output characteristics of the downstream-side exhaust gas sensor, wherein the intermediate target value setting means determines the intermediate target value by the use of the air-fuel ratio detection value linearized by the linearizing means.

15. An air-fuel ratio control apparatus for an internal combustion engine having a catalyst, comprising:

an upstream-side exhaust gas sensor and a downstream-side exhaust gas sensor for detecting an air-fuel ratio or a rich/lean state of an exhaust gas at an upstream-side and a downstream-side of the catalyst for cleaning an exhaust gas, respectively;

air-fuel ratio feedback-control means for feedback-controlling a fuel injection amount so that an air-fuel ratio detected by the upstream-side exhaust gas sensor becomes an upstream-side target air-fuel ratio;

intermediate target value setting means for setting an intermediate target value on the basis of an air-fuel ratio previously detected by the downstream-side exhaust gas sensor and a final downstream-side target air-fuel ratio;

sub-feedback control means for performing a sub-feedback control for correcting the upstream-side target air-fuel ratio on the basis of the air-fuel ratio detected by the downstream-side exhaust gas sensor and the intermediate target value; and control compensation means for correcting the intermediate target value according to the output characteristics of the downstream-side exhaust gas sensor.

* * * * *